US009296455B2

(12) United States Patent
Bernloehr et al.

(10) Patent No.: US 9,296,455 B2
(45) Date of Patent: Mar. 29, 2016

(54) TROLLING MOTOR

(71) Applicants: Darrel A. Bernloehr, Mankato, MN (US); Craig E. Turek, Good Thunder, MN (US); Matthew P. Schumann, Mankato, MN (US)

(72) Inventors: Darrel A. Bernloehr, Mankato, MN (US); Craig E. Turek, Good Thunder, MN (US); Matthew P. Schumann, Mankato, MN (US)

(73) Assignee: Johnson Outdoors Inc., Racine, WI (US)

( * ) Notice: Subject to any disclaimer, the term of this patent is extended or adjusted under 35 U.S.C. 154(b) by 47 days.

(21) Appl. No.: 14/255,668

(22) Filed: Apr. 17, 2014

(65) Prior Publication Data

US 2015/0298782 A1 Oct. 22, 2015

(51) Int. Cl.

| | |
|---|---|
| ***B63H 20/00*** | (2006.01) |
| ***B63H 5/125*** | (2006.01) |
| ***B63H 21/17*** | (2006.01) |
| *B63H 23/02* | (2006.01) |

(52) U.S. Cl.

CPC ..... *B63H 20/007* (2013.01); *B63H 5/125* (2013.01); *B63H 21/17* (2013.01); *B63H 2023/0291* (2013.01)

(58) Field of Classification Search

CPC ..... B63H 21/17; B63H 23/24; B63H 20/007
USPC ..... 440/6, 53, 7, 56; 701/21
See application file for complete search history.

(56) References Cited

U.S. PATENT DOCUMENTS 3,861,628 A * 1/1975 Krieger ..... B63H 20/007 248/642
3,870,258 A * 3/1975 Shimanckas ..... B63H 20/007 248/642
3,915,417 A * 10/1975 Norton ..... B63H 20/007 248/584
3,930,461 A * 1/1976 Brock ..... B63H 20/007 248/642
4,410,161 A * 10/1983 Booty ..... B63H 20/007 248/642
4,555,233 A * 11/1985 Klammer ..... B63H 20/007 440/53
5,129,845 A * 7/1992 Henderson ..... B63H 20/007 440/1
5,386,368 A * 1/1995 Knight ..... G05D 1/0208 114/144 A
5,540,606 A * 7/1996 Strayhorn ..... B63H 20/007 114/144 R
5,884,213 A 3/1999 Carlson
5,892,338 A * 4/1999 Moore ..... B63H 20/007 318/16
6,325,685 B1 * 12/2001 Knight ..... B63H 20/007 440/53

(Continued)

*Primary Examiner* — S. Joseph Morano
*Assistant Examiner* — Jovon Hayes
(74) *Attorney, Agent, or Firm* — Reinhart Boerner Van Deuren P.C.

(57) ABSTRACT

A trolling motor is provided. The trolling motor includes a base assembly with a steering module mounted to the base assembly. The steering module includes an internal drive arrangement for providing an output torque. The steering module also includes a trim module rotatably mounted to an upper portion of the steering module. A motor shaft assembly including a motor shaft, a head unit attached to an upper end of the motor shaft, and a motor power unit attached to a lower end of the motor shaft is also provided. The motor shaft extends through the base assembly, steering module, and trim module. A torque transfer arrangement is mounted between the trim module and the motor shaft of the motor shaft assembly for transferring the output torque provided by the steering module to the motor shaft to rotate the motor shaft assembly about a rotational steering axis.

20 Claims, 17 Drawing Sheets

(56) References Cited

U.S. PATENT DOCUMENTS 6,369,542 B1 * 4/2002 Knight ..... B63H 20/007 313/16
6,431,923 B1 * 8/2002 Knight ..... B63H 20/007 440/6
7,056,166 B2 * 6/2006 Bernloehr ..... B63H 20/007 114/144 R
7,294,029 B1 * 11/2007 Spaulding ..... B63H 20/36 440/53
7,887,381 B2 * 2/2011 Brass ..... B63B 35/71 114/347
8,463,458 B2 * 6/2013 Wood ..... G01C 21/00 701/2
8,463,470 B2 6/2013 Wood et al.
8,543,269 B1 * 9/2013 Wood ..... G01C 21/203 340/995.19
8,577,525 B2 11/2013 Wood et al.
8,606,432 B1 12/2013 Wood et al.
8,645,012 B2 * 2/2014 Salmon ..... G05D 1/0206 701/21
8,761,976 B2 * 6/2014 Salmon ..... B63H 21/21 440/6
2007/0232159 A1 * 10/2007 Lee ..... B63H 20/007 440/53
2015/0298782 A1 * 10/2015 Bernloehr ..... B63H 5/125 440/6

* cited by examiner

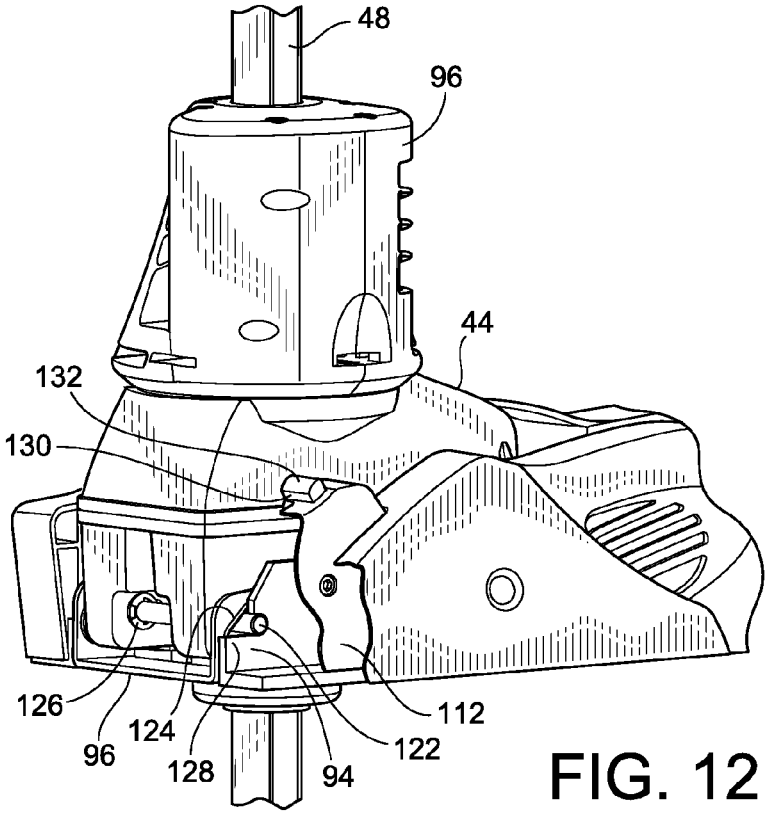
FIG. 12
FIG. 13
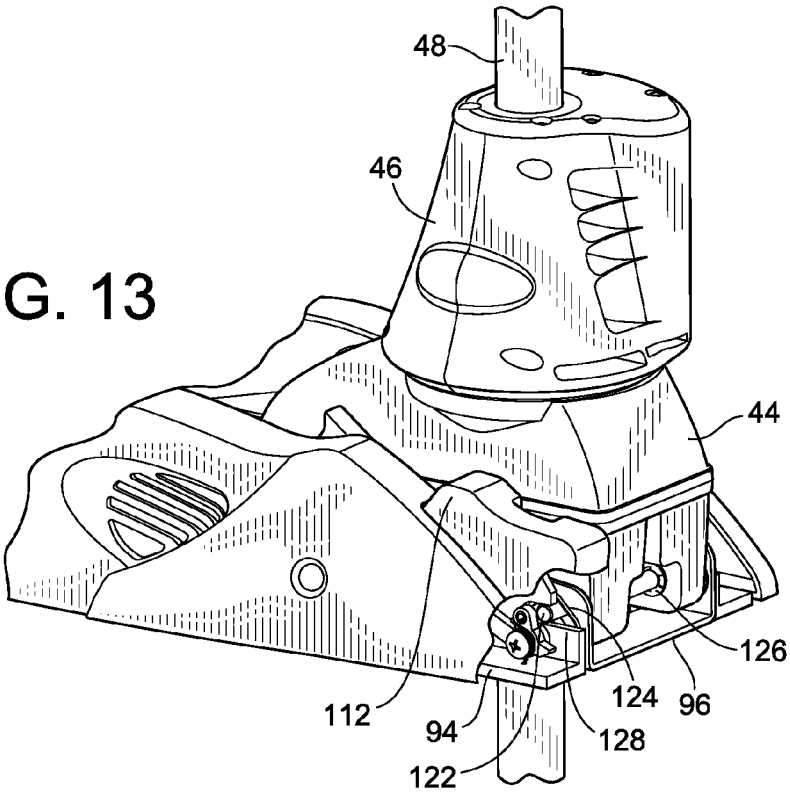

TROLLING MOTOR

FIELD OF THE INVENTION

This invention generally relates to watercraft equipment, and more particularly to trolling motors.

BACKGROUND OF THE INVENTION

Fishing boats and other vessels are often equipped with a trolling motor for providing a relatively small amount of thrust to slowly and quietly propel the boat or vessel. They advantageously provide for a finer adjustment of watercraft position than a main motor/propeller combination. Typically, the trolling motor is powered electrically using a boat's existing electrical power source, or a stand-alone electrical power source which in either case is most often a battery. Examples of a contemporary trolling motor may be found at U.S. Pat. Nos. 6,325,685 and 6,369,542 to Knight et al., the entire teachings and disclosures of which are incorporated by reference herein.

Trolling motors remain a viable and sought after apparatus for various applications, including but not limited to fishing, recreation, and commercial applications. They typically include provisions for placing the same into a stowed position during transportation. In the stowed position, the trolling motor is generally horizontal and parallel with a top surface of the bow. In the past, a manual manipulation of the trolling motor was required to place it in the stowed position. As an example, a user would rotate the motor shaft assembly which includes a motor shaft, a motor power unit and optionally a head unit, about the base assembly of the trolling motor from a deployed position in which the motor shaft assembly was generally perpendicular to the top surface of the boat, to the aforementioned stowed position.

Trolling motors also typically include a trim adjustment feature which allows a user to vary the distance between the motor power unit including its associated propeller and the mounting location of the trolling motor. This allows a user to operate the trolling motor in shallower waters, or conversely allows a user to ensure the propeller is sufficiently spaced away from the boat hull. This trim adjustment feature in the past has been provided as a manually manipulated feature which essentially amounted to a collar through which the motor shaft assembly was slidable. A set screw or other locking feature is provided on the collar such that when loosened the motor shaft assembly is slidable relative to the collar, and when tightened, the motor shaft assembly is locked at a specific height.

Due to the growing complexity and size of trolling motor systems in recent years, the aforementioned manually manipulated stow/deploy and trim adjustment mechanisms have become difficult if not infeasible to implement. The increased weight and size of newer trolling motor designs essentially made manual manipulation undesirable. As such, recent developments in trolling motor designs have attempted to address this issue by providing mechanically assisted or entirely automated stow/deploy and trim adjustment mechanisms. While such systems have proven to be quite effective, current designs generally have a relatively complex design with a high part count.

As such, there is a growing need in the art for a trolling motor that provides such mechanically assisted or automated stow/deploy and trim adjustment mechanisms with a reduction of parts but retention of functionality. Such a trolling motor would advantageously provide a user with a contemporary trolling motor at a lower cost of purchase, operation, and maintenance given its more compact and efficient design.

The invention provides such a trolling motor. These and other advantages of the invention, as well as additional inventive features, will be apparent from the description of the invention provided herein.

BRIEF SUMMARY OF THE INVENTION

In one aspect, the invention provides a trolling motor that presents a compact, relatively low part count configuration relative to contemporary designs. The trolling motor includes a base assembly including a motor mount and a base plate, the motor mount rotatably mounted to the base plate such that the motor mount is rotatable relative to the base plate about a first axis. The trolling motor also includes a steering module rotatably mounted to the base assembly such that the steering module is rotatable relative to the base plate about the first axis. The trolling motor also includes a trim module rotatably mounted to an upper portion of the steering module, the trim module rotatable about a second axis transverse to the first axis and rotatable about the first axis with the steering module. A motor shaft assembly is also provided including a motor shaft, a head unit attached to an upper end of the motor shaft, and a motor power unit attached to a lower end of the motor shaft. The motor shaft extends through the base assembly, steering module, and trim module. The motor shaft assembly is linearly movable relative to each of the base assembly, steering module, and trim module about the second axis and rotatable about the second axis relative to the steering module and base assembly. The motor shaft assembly is rotatable about the first axis with the trim module, steering module, and motor mount. The trolling motor also includes a linear actuation arrangement mounted between the base plate, the motor mount, and the steering module for rotating the motor mount, steering module, trim module, and motor shaft assembly simultaneously about the first axis.

In another aspect, the invention provides a trolling motor that provides a reduction of parts but a retention of the functionality of contemporary automated stow/deploy and trim adjustment systems. The trolling motor includes a base assembly with a steering module mounted to the base assembly. The steering module includes an internal drive arrangement for providing an output torque. The steering module also includes a trim module rotatably mounted to an upper portion of the steering module in response to the output torque. A motor shaft assembly including a motor shaft, a head unit attached to an upper end of the motor shaft, and a motor power unit attached to a lower end of the motor shaft is also provided. The motor shaft extends through the base assembly, steering module, and trim module. A slip ring assembly is positioned between steering module and the trim module. Electrical power is transmitted from an internal control module of the steering module through the slip ring assembly and to the trim module to provide electrical power to the slip ring assembly.

In certain embodiments, the linear actuation arrangement includes a damper and a linear actuator mounted on opposed sides of the base plate. The linear actuator includes an end effector which is coupled to a coupling arrangement formed between the base plate and the motor mount. The coupling arrangement includes a first link rotatably mounted to the base plate and rotable about the first axis, and a second link which is a rigid extension of the motor mount. A locking member selectively couples the first link to the second link such that in a locked configuration the second link cannot rotate about the first axis relative to the first link, and in an unlocked configuration, the second link is free for rotation about the first axis relative to the first link.

In certain embodiments, the trim module includes an internal drive arrangement for linearly moving the motor shaft assembly about the second axis. The internal drive arrangement includes a drive motor operably coupled to an input drive gear of the internal drive arrangement. The input gear is mounted for rotation about a first input axis. The internal drive arrangement further comprises a worm gear mounted for rotation with the input drive gear and extending along the first input axis. The first input axis is parallel to the second axis. The internal drive arrangement further comprises an intermediary drive gear rotatably mounted about a second input axis which is perpendicular to the first input axis, the intermediary drive gear in meshed contact with the worm gear. The internal drive arrangement further comprises a belt drive gear coupled for rotation with the intermediary drive gear about the second input axis.

In certain embodiments, the motor shaft assembly includes a belt mounted within a channel of the motor shaft. The belt includes a plurality of gear teeth on an interior side thereof, wherein a portion of the belt is routed around the belt drive gear and in meshed contact therewith.

In certain embodiments, the steering module includes an internal drive arrangement including an input drive motor, a drive gear, and a drive train coupled between the input drive motor and the drive gear. A drive collar extends axially way from the drive gear and is rotatable with the drive gear about the second axis. The motor shaft extends through the drive gear and drive collar. A pair of protrusions extend axially way from the drive collar and axially away from an upper outer surface of the steering module. The pair of protrusions are received within a pair of corresponding apertures formed through a bottom wall of the trim module such that rotation of the drive collar about the second axis results in a like rotation of the trim module about the second axis.

In yet another aspect, the invention provides a power depth collar for adjusting the trim of a trolling motor. The power depth collar includes a bore extending through the power depth collar configured for receiving a motor shaft of a motor shaft assembly of a trolling motor. An actuation arrangement is contained within a housing of the power depth collar. The actuation arrangement operable to linearly move the motor shaft within the bore. An internal control arrangement is situated within the housing and in operable communication with one or more sensors to sense a linear position of the motor shaft.

In certain embodiments, the actuation arrangement includes a belt drive gear operable to mesh with a drive belt of the motor shaft assembly. In certain other embodiments, the actuation arrangement includes a drive gear operable to mesh with a rack of the motor shaft assembly. In certain other embodiments, the actuation arrangement includes one or more friction rollers for frictionally bearing against the motor shaft assembly to linear move the motor shaft assembly upon rotation of the friction rollers.

In this configuration, the internal control module is connected to a power source independently of the trolling motor.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 12 is a perspective view of the trolling motor, with a portion thereof cut away to expose a pin and slot mate between a motor mount and a base of the trolling motor, and also showing a stowed position sensor;

FIG. 13 is a perspective view of the trolling motor, with a portion thereof cut away to expose a pin and slot mate between the motor mount and base, opposite that shown in FIG. 12;

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
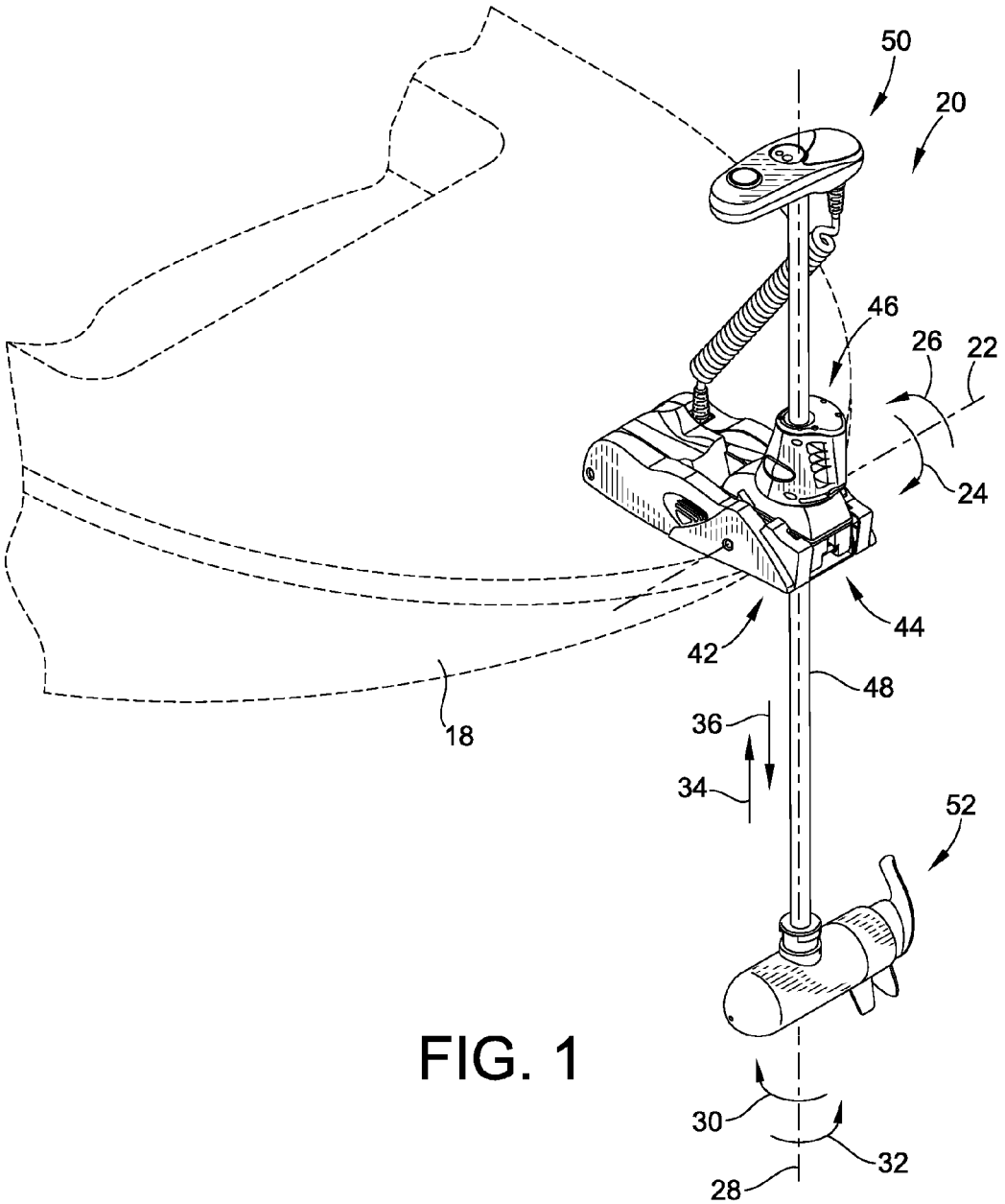
FIG. 1 is a perspective view of an exemplary embodiment of a trolling motor according to the teachings of the present invention, shown mounted to a watercraft and in a deployed position.

Turning now to the particular embodiment shown in the drawings, a trolling motor unit 20 is illustrated therein. With particular reference to FIG. 1, trolling motor 20 is shown mounted at the bow of a schematically represented watercraft 18. Trolling motor 20 is not in any way limited to any particular watercraft, and also may include various additional mounting brackets or the like were necessary for adequate mounting. Trolling motor 20 overcomes existing problems in the art by offering a trolling motor which provides a reduction of parts and complexity over contemporary systems relative to its stow/deploy, trim adjustment, and other features, while retaining the functionality thereof.

Still referring to FIG. 1, trolling motor unit 20 includes a base assembly 42 mounting trolling motor unit 20 to watercraft 18. Trolling motor unit 20 also includes a steering module 44 which effectuates the steering capabilities of trolling motor unit 20, a trim module 46 (also referred to herein as a power depth collar) which effectuates trim adjustment of trolling motor unit 20 by adjusting the vertical position of a motor shaft assembly comprising a motor shaft 48, as well as a head unit 50 and motor power unit 52 mounted at opposed ends of motor shaft 48. As will be explained below, head unit 50 includes appropriate control circuitry to achieve the functionality described herein relative thereto, and may include additional navigational electronics such as GPS navigational systems or the like. Motor power unit 52 includes an internal drive motor and its associated componentry to effectuate the rotation of a propeller of motor power unit 52.

Figure 2:
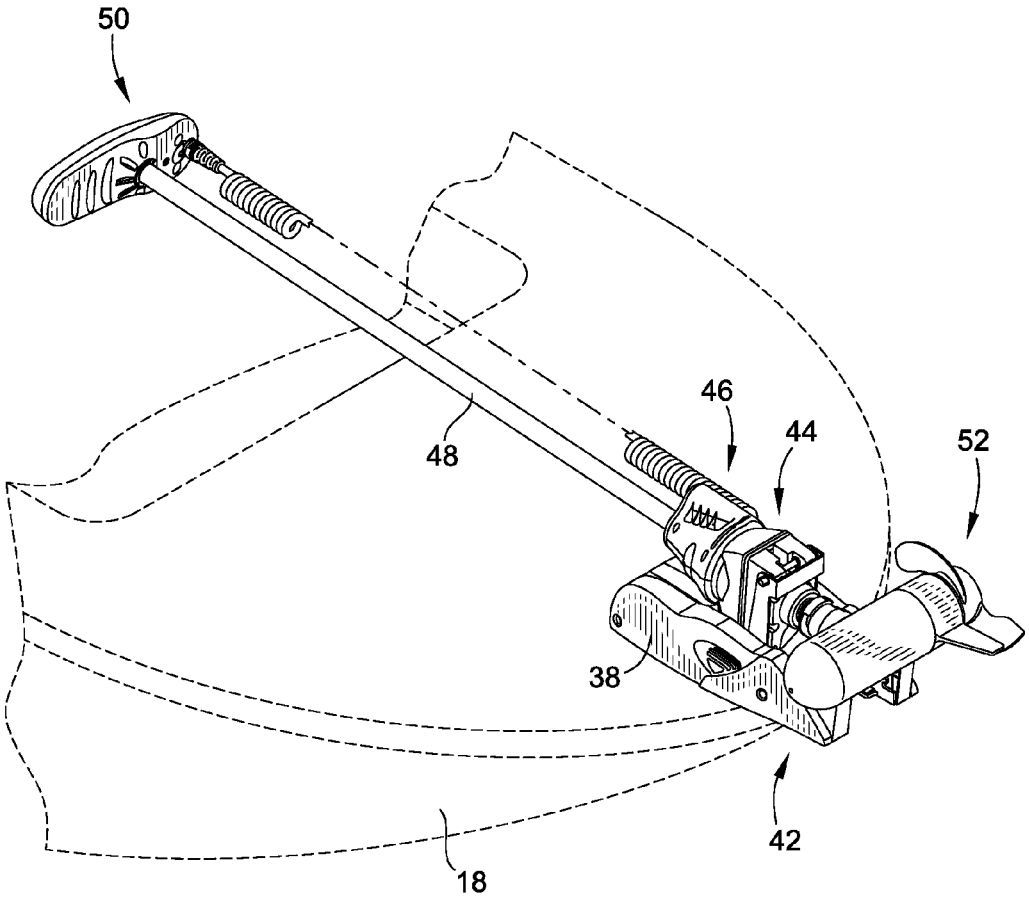
FIG. 2 is a perspective view of the trolling motor of FIG. 1, shown in a stowed position.

More specifically, trolling motor unit defines a first axis 22 about which a portion of base assembly 42, steering module 44, trim module 46, motor shaft 48, head unit 50, and motor power unit 52 are rotatable about in first and second rotational directions 24, 26. Rotation of these components about first axis 22 and first rotational direction 24 will place trolling motor unit in a stowed position as shown in FIG. 2 wherein trolling motor unit 20 is not operable to provide any positioning of watercraft 18. These components are rotatable about first axis 22 in the second rotational direction 26 from the stowed position to place trolling motor unit 20 in a deployed position wherein trolling motor unit 20 is operable to govern the positioning of watercraft 18.

Trolling motor unit 20 also defines a second axis 28. Trim module 46, motor shaft 48, head unit 50, and motor power unit 52 are rotatable in first and second rotational directions 30, 32 about second axis 28 to effectuate the steering of watercraft 18 by directing thrust provided by motor power unit 52. Motor shaft 48, head unit 50, and motor power unit 52 are also vertically adjustable along the second axis 28 in first and second linear directions 34, 36 to provide for the aforementioned trim adjustment by changing the vertical position of motor power unit 52 relative to base assembly 42.

As can be seen from inspection of FIG. 2, when in the stowed position, trolling motor unit 20 is positioned in a generally horizontal configuration and secured in place when not in use. Although not illustrated, trolling motor 20 may also include strap or other componentry to maintain trolling motor in this position. When a user is ready to deploy trolling motor unit 20, a stow/deploy arrangement of trolling motor unit 20 is operable to rotate the aforementioned components of trolling motor unit 20 about first axis 22 in second rotational direction 26 (See FIG. 1).

Figure 3:
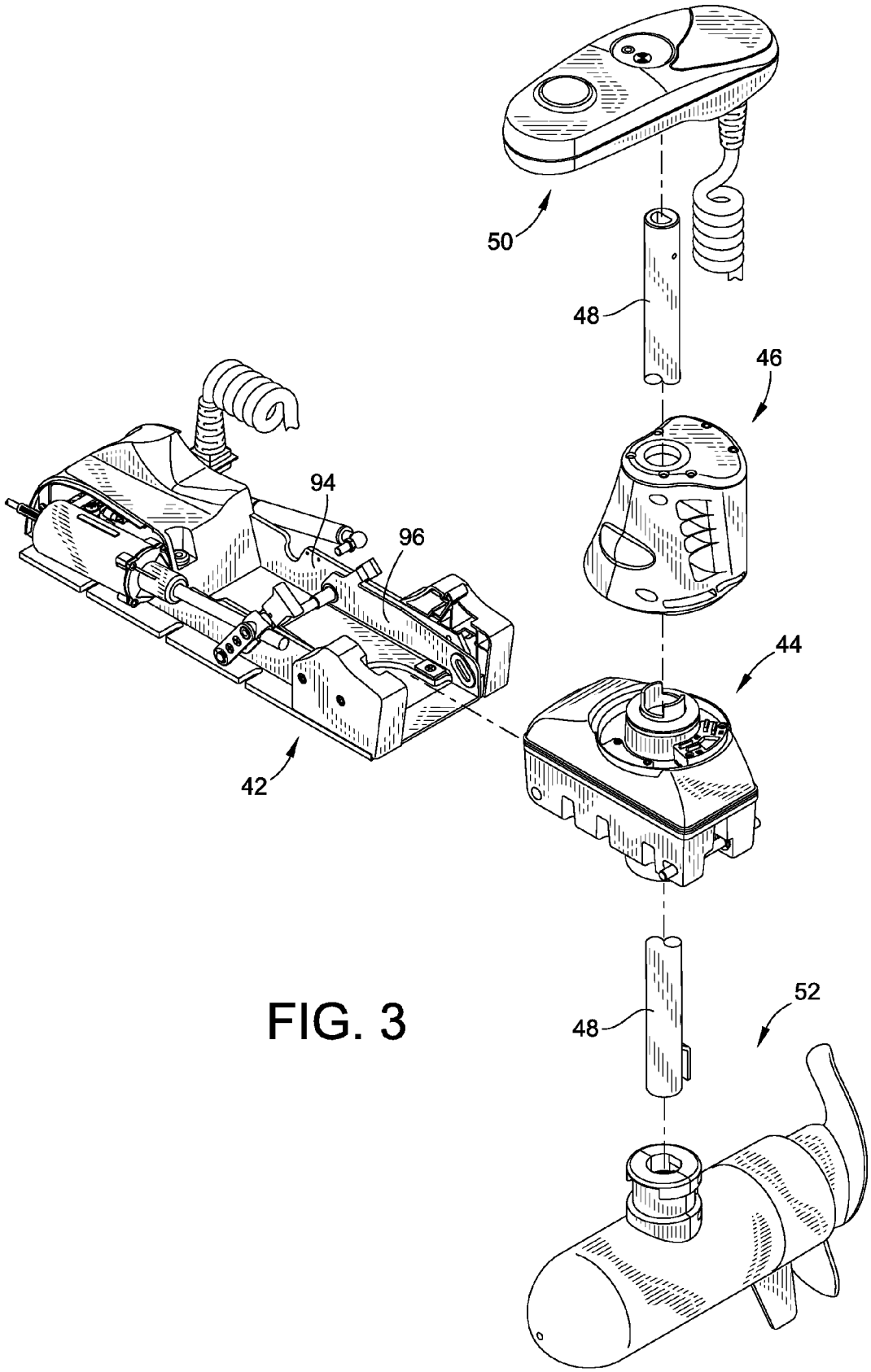
FIG. 3 is a perspective exploded view of the trolling motor of FIG. 1.

With reference now to FIG. 3, an exploded view of trolling motor unit 20 is provided. As can be seen in this view, base assembly 42 includes a base plate 94 (See FIG. 1) with a motor mount 96 pivotally mounted thereto such that motor mount 96 is rotatable about first axis 22 relative to base plate 94. It will be noted that cosmetic coverings 38 (see FIG. 2) of base assembly 42 have been removed therefrom for purposes of clarity. Motor mount 96 is positioned adjacent and underneath steering module 44. Trim module 46 is mounted on top of steering module 44. Motor shaft 48 extends through each of steering module 44 and trim module 46. Openings are also formed through the bottoms of base plate 94 and motor mount 96 such that motor shaft 48 is extendable through the same. Head unit 50 is mounted at an upper end of motor shaft 48. Motor power unit 52 is mounted at a lower end of motor shaft 48. As a result, rotation of motor mount 96 relative to base plate 94 rotates steering module 44 carried by motor mount 96 as well. Trim module 46, motor shaft 48, head unit 50, and motor power unit 52 translate with steering module 44 given their direct or indirect connection thereto as introduced above.

In the following, a general description will be provided as to the control and communication scheme between the various components of trolling motor unit 20 will be provided. Thereafter, the structural attributes of each of base assembly 42, steering module 44, and trim module 46 will be discussed.

Figure 4:
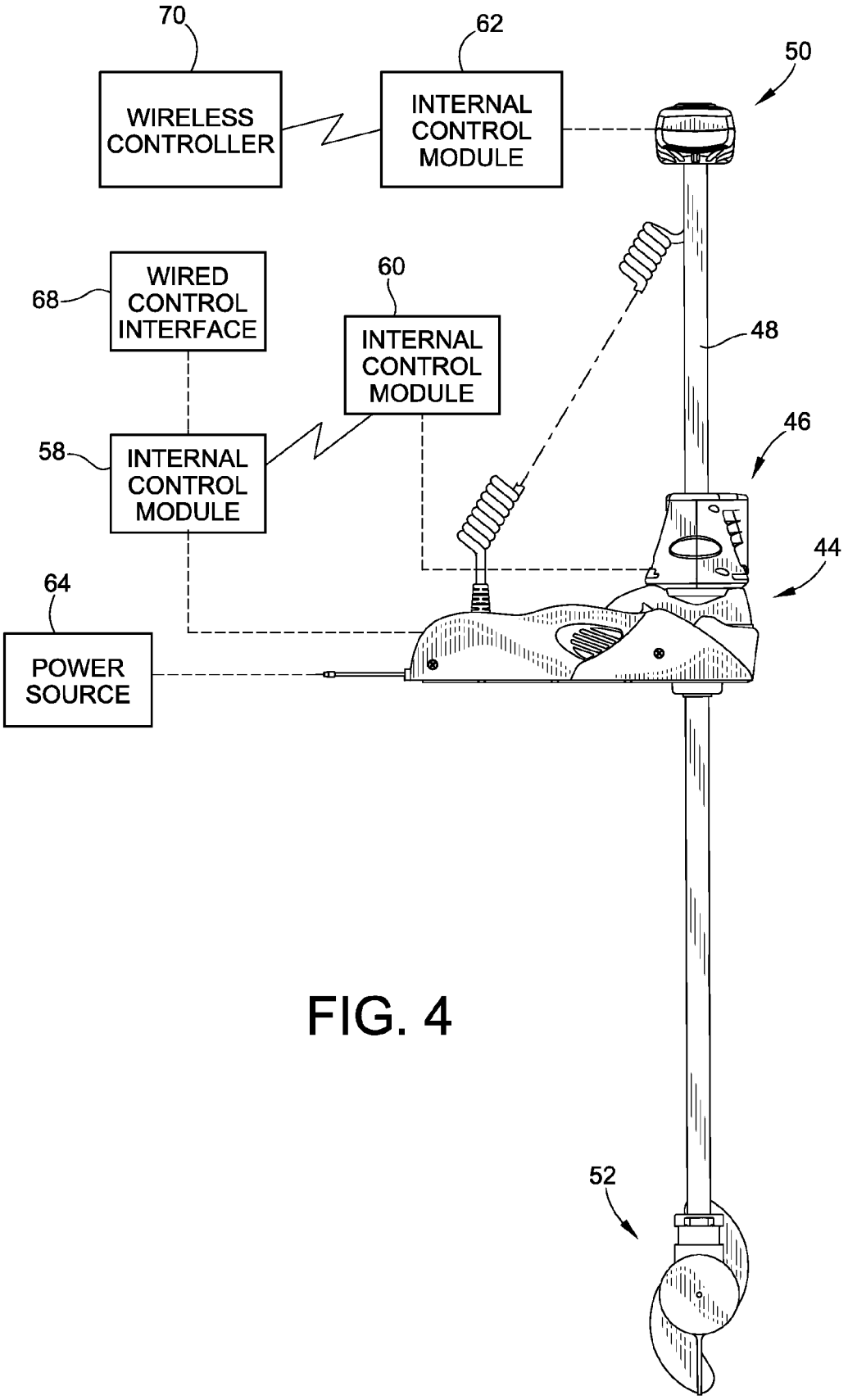
FIGS. 4 and 5 are schematic views of the control and communication schemes of the trolling motor.
Figure 5:
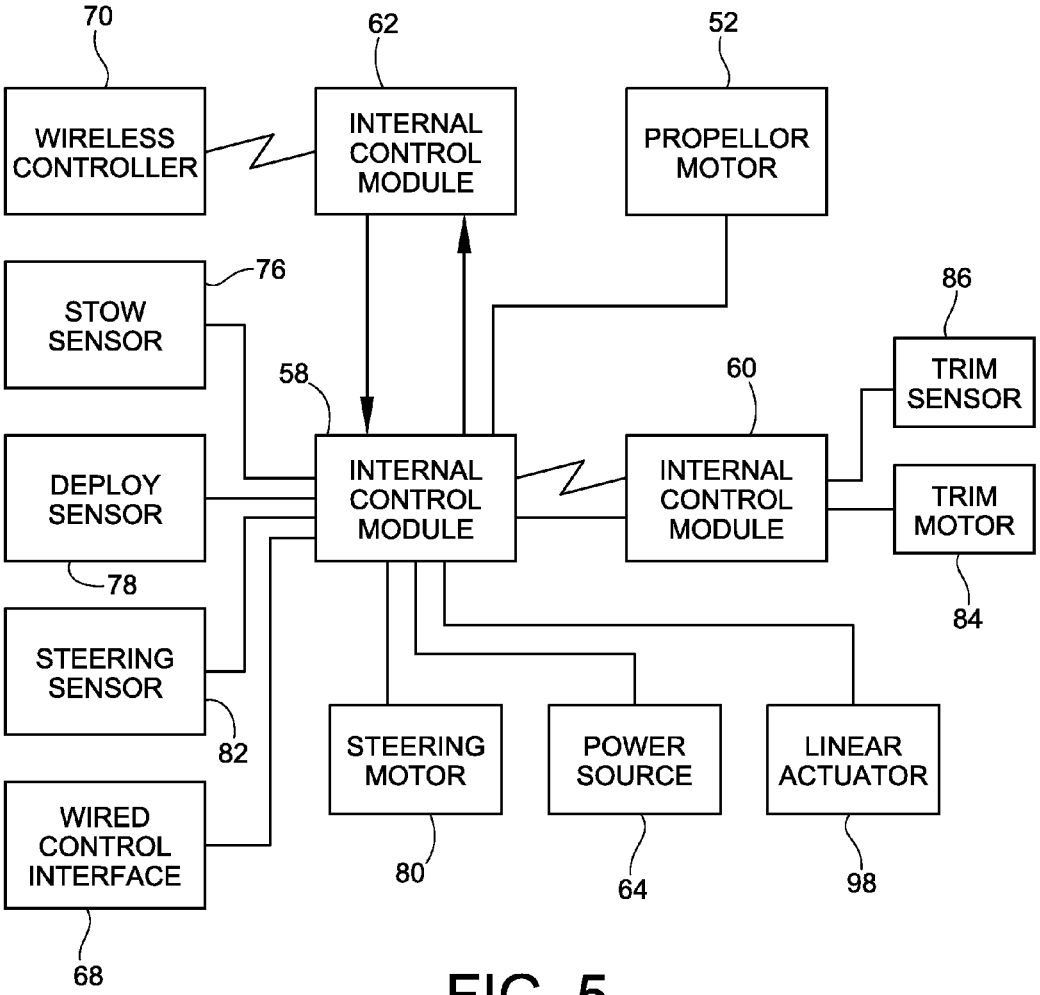

Turning now to FIGS. 4 and 5, a brief introduction to control and communication scheme of trolling motor unit 20 will be provided. With particular reference to FIG. 4, base assembly 42 includes an internal control module 58 which is connected to a power source 64 for providing power to trolling motor unit 20. Internal control module 58 is operable to wirelessly communicate with an internal control module 60 of trim module 46, but may in other embodiments be hard wired directly to internal control module 60. A wired control interface 68 may be connected to internal control module 58 for providing control signals to internal control module 58. Non-limiting examples of such a wired control interface 68 include pedal-type controllers typically utilized with trolling motors, joysticks, etc. Steering commands sent from wired control interface 68 are received by internal control module 58.

Internal control module 58 is thereafter capable of sending an appropriate control signal to steering module 44 which is directly connected by a wired connection to internal control module 58 to effectuate the rotation of trim module 46, motor shaft 48, head unit 50, and motor power unit 52 about second axis 28 (See FIG. 1). Trim control signals provided by wired control interface and received by internal control module 58 are wirelessly communicated from internal control module 58 to internal control module 60 of trim module 46. Internal control module 60 is thereafter operable to linearly move motor shaft 48, head unit 50, and motor power unit 52 linearly along second axis 28.

In addition or in the alternative to providing such a wired control interface as discussed above, it is also possible to utilize a wireless controller 70 which communicates with an internal control module 62 of head unit 50. Steering and trim commands communicated wirelessly from wireless controller 70 to internal control module 62 are interpreted by control module 62 and sent via direct wired connection to internal control module 58.

In the case of a steering command, the same is thereafter directly utilized by internal control module 58 to govern the steering position of trolling motor unit 20. Trim signals sent by wireless controller 70 to internal control module 62 are thereafter sent to internal control module 58, and then wirelessly communicated to internal control module 60 from internal control module 58 to effectuate the trimmed position of trolling motor unit 20. Those skilled in the art will recognize that the term "internal control module" includes all of firmware, hardware, and software necessary to achieve the above described control and communication.

A block diagram of the aforementioned communication and control scheme of trolling motor unit 20 is illustrated in FIG. 5, which also includes the various sensors and drive systems of trolling motor 20. As can be seen therein, internal control module 58 is connected by way of a wired connection (and communicates with where appropriate) with internal control module 62, a steering motor 80 of steering module 44, power source 64, stow and deploy sensors 76, 78 (described below), steering sensor 82 (described below), wired control interface 68, a linear actuator 98 (described below), and motor power unit 52 of motor shaft assembly.

Additionally, internal control module 58 is also directly connected with internal control module 60 for the limited purpose of providing power thereto from power source 64 via slip ring arrangement as described below. As discussed above, trim commands are communicated wirelessly to internal control module 60 from internal control module 58. Internal control module 60 is also connected to a trim sensor 86 which provides for the detection of the trimmed position of trolling motor unit 20 as described below. Internal control module 60 is also directly connected to a trim motor 84 of trim module 46 and is operable to control the same.

Internal control module 62 of head unit 50 is in wireless communication with a wireless control 70 as discussed above. Internal control module 58 is also in direct connection with a propeller motor 88 of motor power unit 52. This direct connection with propeller motor 88 is achieved by routing lead wires from head unit 50 to motor power unit 52 through an internal cavity of motor shaft 48. Motor power unit 52 may be embodied by any trolling motor motor power unit and as such is not limiting on the invention herein. It will be recognized that the particular sizing of motor power unit 52 will vary depending upon application.

Internal control module 62 of head unit 50 may also utilize integrated GPS location and navigation technology such as that described in U.S. Pat. Nos. 5,386,368, 5,884,213, 8,463,470, 8,463,458, 8,577,525, 8,606,432, 8,543,269, as well as U.S. patent application Ser. Nos. 13/479,381, and 13/174,944. The teachings and disclosures of each of the aforementioned issued patents and pending applications are incorporated by reference herein in their entireties.

Figure 6:
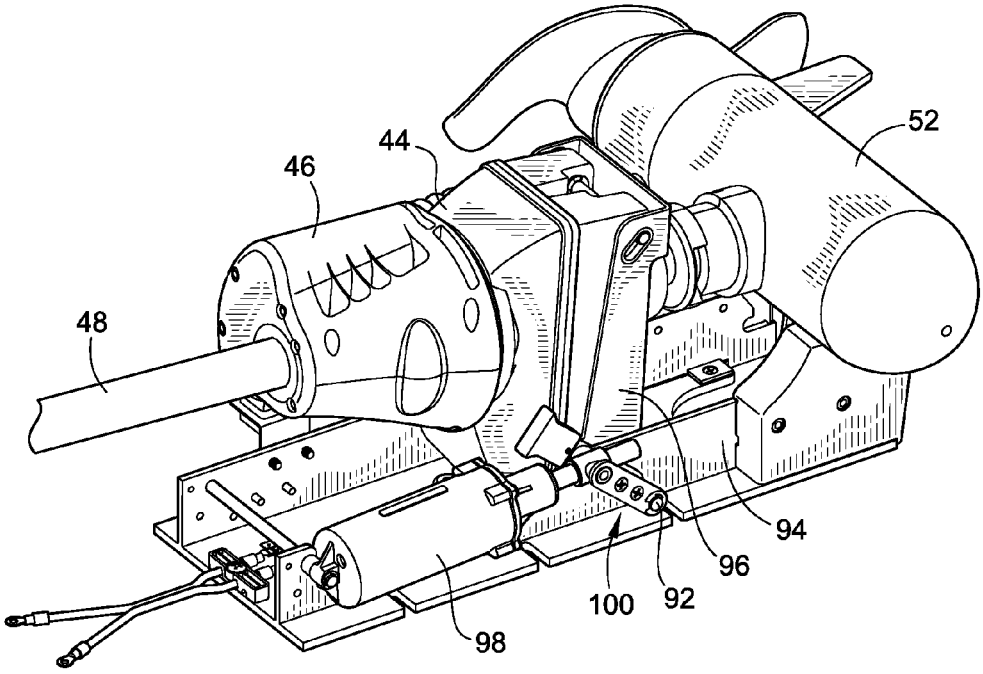
FIG. 6 is a perspective view of the trolling motor, in the stowed position and with a linear actuator of the trolling motor exposed.

Having described the control and communication scheme of trolling motor 20, the description will now turn to the structural attributes of trolling motor 20, in particular base assembly 42, steering module 44, and trim module 46. Turning now to FIG. 6, base assembly 42 will be described in greater detail. As stated above, base assembly 42 includes a base plate 94 and a motor mount 96 rotatably mounted to base plate 94 by way of a pin 92. Motor mount 96 is rotatable relative to base plate 94 about first axis 22 (See FIG. 1) at pin 92 to ultimately transition trolling motor unit 20 from the stowed position to the deployed position and from the deployed position to the stowed position.

As will be described in the following, base assembly 42 includes a linear actuation arrangement to achieve the aforementioned rotation. This linear actuation arrangement includes a linear actuator 98 as well as a damper 118 (See FIG. 9). However, those skilled in the art will recognize from the following, that while damper 118 provides additional advantages as described below, linear actuation arrangement may include a linear actuator only as opposed to both a linear actuator and a damper. The linear actuator 98 is mounted to base plate 94 and connected to a coupling arrangement 100. Extension and retraction of linear actuator 98 results in the rotation of coupling arrangement 100 to rotate motor mount 96 relative to base plate 94 about pin 92.

Figure 7:
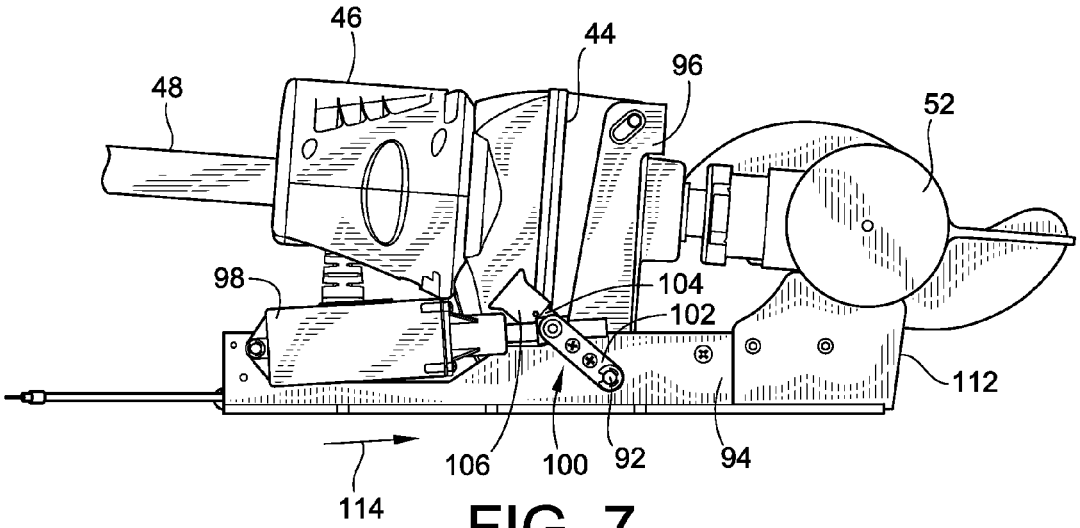
FIG. 7 is a side view of the trolling motor, also showing the linear actuator shown in FIG. 6, in the stowed position.

With particular reference now to FIG. 7, coupling arrangement 100 includes a first link 102 and a second link 104. A locking member 106 is disposed between first and second links 102, 104. Locking member 106 is operable to lock first and second links 102, 104 to such rotation of first link 102 as a result of movement of linear actuator 98 results in a corresponding rotation of second link 104. As will be discussed in greater detail below, however, it is possible to transition locking member 106 such that first link 102 and second link 104 are no longer coupled with one another so that it is possible to rotate second link 104 relative to first link 102.

First link 102 is generally an arm that is pivotally connected about pin 92. An extendable and retractable end of linear actuator 98 is coupled to first link 102 as shown. Second link 104 is formed as a rigid extension of motor mount 96. As a result, any rotation of first link 102 results in a like rotation of motor mount 96 when locking member 106 is in its locked position.

As can be seen in FIG. 7, linear actuator 98 is in its fully retracted position. In this position, movement of linear actuator 98 has caused first link 102 to rotate about first axis 22 in second rotational direction 26. As a result, motor mount 96 is generally perpendicular relative to base plate 94.

In the fully stowed position, motor power unit 52 rests upon propeller mounts 112 as shown. Propeller mounts 112 include a contoured surface which generally matches the outer surface of motor power unit 52. As introduced above and described below, trolling motor unit 20 includes a stow sensor 76 that detects when trolling motor 20 is in its fully stowed position. From this stowed position, extension of linear actuator 98 in linear direction 114 will result in rotation of first and second links 102, 104 and thus motor mount 96 about first axis 22 in the first rotational direction 24 to ultimately transition trolling motor unit 20 from its stowed position to its deployed position.

Figure 8:
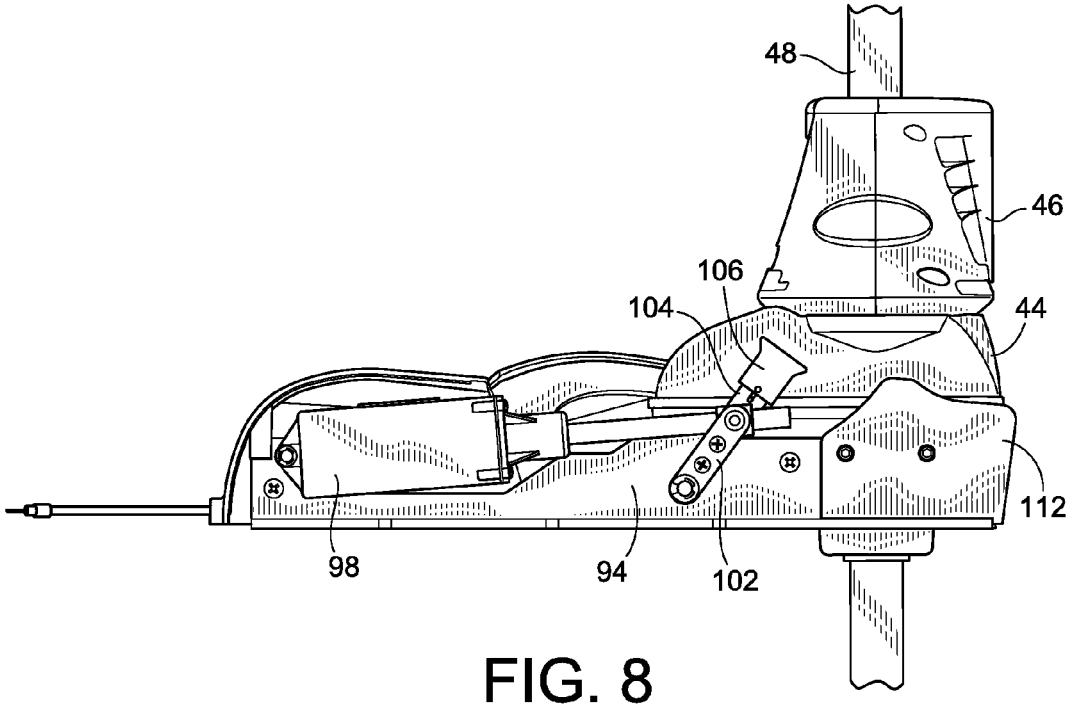
FIG. 8 is a perspective view of the trolling motor, showing the linear actuator of FIGS. 6 and 7, in the deployed position.

With reference now to FIG. 8, trolling motor unit 20 is illustrated in the deployed position. Linear actuator 98 is now extended and as a result, first and second links 102, 104 have been rotated in second rotational direction about first axis 22. Motor mount 96 has thus transitioned to a generally parallel configuration with base plate 94.

Figure 9:
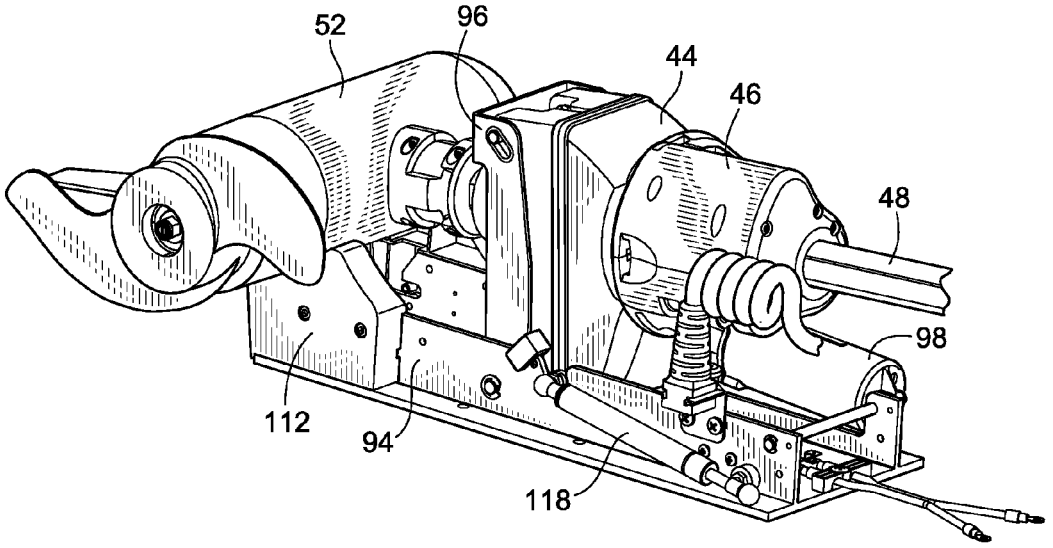
FIG. 9 is a perspective view of the trolling motor, in the stowed position and with a damper of the trolling motor exposed.

Turning now to FIG. 9, the other side of base assembly 42 from that shown in FIGS. 7 and 8 is illustrated. As can be seen in this view, base assembly 42 also includes a damper 118. Damper 118 is connected to base plate 94 at one end thereof, and is connected to steering module 44 at another end thereof. The above-described rotation of steering module 42 and motor mount 96 as a result of extension and retraction of linear actuator 98 is dampened by damper 118 for purposes of vibration reduction. Damper 118 may be embodied as any conventional damper.

Figure 10:
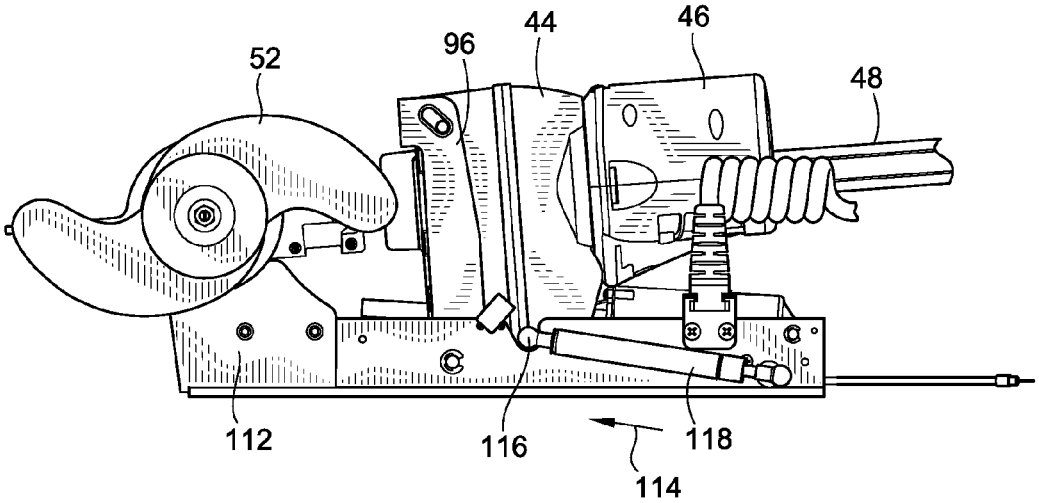
FIG. 10 is a side view of the trolling motor, showing the damper of FIG. 9 in the stowed position.
Figure 11:
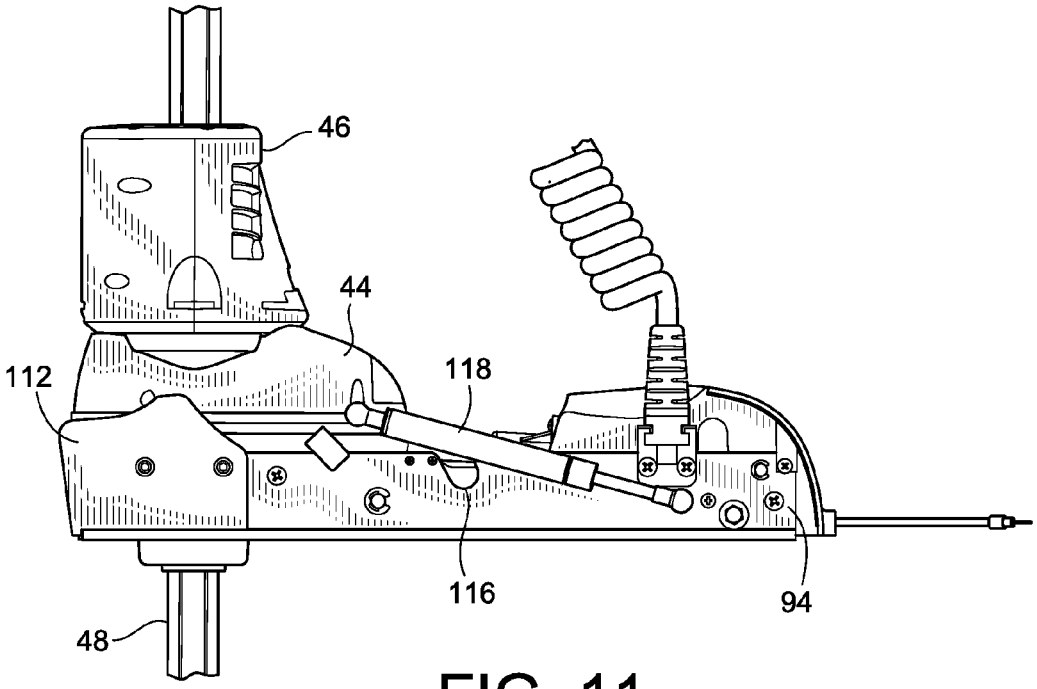
FIG. 11 is a side view of the trolling motor, showing the damper of FIGS. 9 and 10 in the deployed position.

As can be seen in FIG. 10, in the fully stowed position, the connection point between damper 118 and steering module 44 is seated within a slot 116 formed in a sidewall of base plate 94. As trolling motor unit 20 transitions from its stowed position to its deployed position, damper 118 will linearly extend generally along direction 114 while dampening any vibration caused by this movement as shown in FIG. 11. As such, linear actuator 98 and damper 118 provide a linear actuation arrangement for transitioning trolling motor unit 20 between a stowed position and a deployed position and vice versa. This configuration overcomes existing problems in the art by providing a relatively simple actuation means.

Turning now to FIG. 12, a locking arrangement is formed between base plate 94 and motor mount 96 of base assembly 42. This locking arrangement includes a locking pin 122 which extends entirely through steering module 44 through horizontal slots 126 formed therethrough. Locking pin 122 also extends through angled slots 124 on either side of motor mount 96. Locking pin also extends through open ended slots 128 formed in the sidewalls of base plate 94. Trolling motor unit 20 is in the deployed position as illustrated in FIG. 12. As can be seen in FIG. 12, and as will be described in greater detail below, locking pin 122 prevents unwanted rotational movement of motor mount 96, and thus all components carried thereby, about first axis 22.

Indeed, as can be seen at FIG. 12, pin 122 is biased to a rear of open ended slot 128 due to the angle of angled slot 124. As a result, motor mount 96 and the attendant componentry carried thereby will not rotate relative to base plate 94 about first axis 22 without the deliberate movement of motor mount 96 by way of linear actuator 98 or by manual manipulation as discussed below.

Additionally, as can be seen in FIG. 12, a portion of the above-referenced stow sensor 76 extends through an opening 130 formed in propeller mount 112. This portion of stow sensor 76 is in the form of a depressible button 132. When motor power unit 52 is in the fully stowed position and thus resting on propeller mounts 112, depressible button 132 is depressed thereby. Depressible button 132 may take the form of any pressure based switch, hall effect sensor, and send a corresponding signal to internal control module 58 of base assembly 42 and is operable to provide an indication that trolling motor 20 is in the stowed position.

Turning now to FIG. 13, an identical slot configuration as that described above relative to FIG. 11 is formed on the other side of base assembly 42. This portion of base assembly 42 also includes a propeller mount 112. However, this propeller mount 112 does not include a depressible button for position detection. Rather, and turning now to FIG. 14, this side of base assembly 42 includes the above-introduced deploy sensor 78 in the form of a rotatable arm 136 and hall effect sensor 140. As can be seen in this view, a portion of rotatable arm extends into open ended slot 128. Rotatable arm 136 is biased forward within open ended slot 128 such that locking pin 122 will bias this portion of rotatable arm 136 rearwardly into horizontal slot 128 when trolling motor unit 20 is in the fully deployed position.

Figure 14:
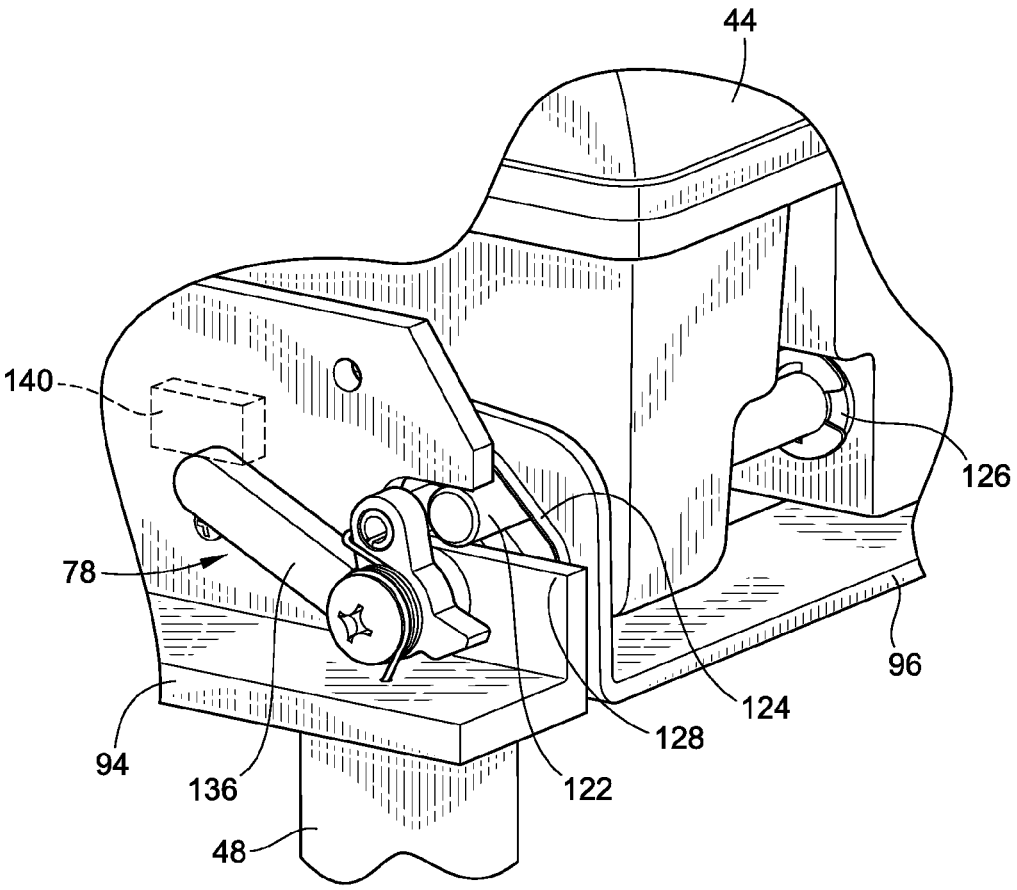
FIG. 14 is a perspective view of the trolling motor, showing a deployed position sensor.

This causes a projection 138 of rotatable arm 136 to come into proximity with a Hall effect sensor 140 schematically shown in FIG. 13. Projection 138 includes a magnet therein which when brought into the orientation shown in FIG. 13 will be detected by Hall effect sensor 140. Hall effect sensor 140 is connected to internal control module 58 of base assembly 42, and thus provides an indication that trolling motor unit 20 is in the fully deployed position. When locking pin 122 is not in contact with rotatable arm 136, rotatable arm 136 is rotated about its mounting axis 142 in a clockwise direction as shown in FIG. 14. Such biasing may be achieved by a simple spring element arranged about rotatable member 136.

Figure 15:
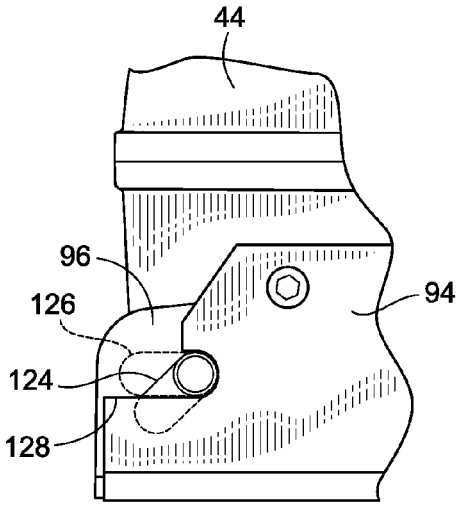
FIG. 15-17 are partial side views showing the interaction of the pin and slot shown in FIGS. 11 and 12 as the trolling motor transitions from the stowed position to the deployed position.
Figure 16:
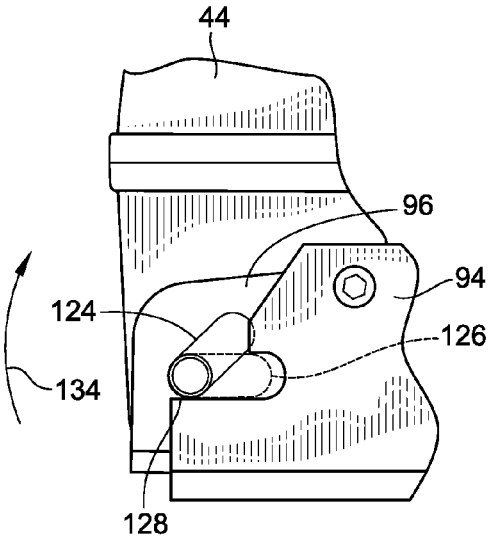
Figure 17:
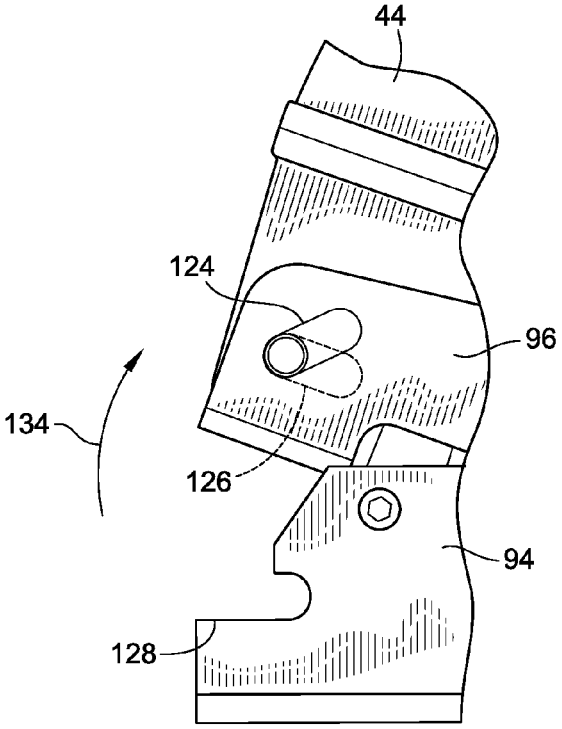

FIGS. 15-17 illustrate the interaction between locking pin 122, horizontal slot 126, angled slot 124, and open ended slot 128. With particular reference to FIG. 15, as can be seen therein, locking pin 122 is seated at its rear-most position with open ended slot 128 when trolling motor unit 20 is in the fully deployed position. Turning now to FIG. 16, however, as motor mount 96 rotates in direction 134 relative to steering module 44 and base plate 94, angled slot 124 will bias locking pin 122 forward with an open ended slot 128 as well as horizontal slot 126 formed in steering module 42. It will be recognized that during this stage of movement, motor mount 96 moves relative to steering module 44 as well as base plate 94 until locking pin 122 is free of open ended slot 128.

With reference to FIG. 17, continued movement of motor mount 96 causes locking pin 122 to seat at the lower-most portion of angled slot 124 and in the forward-most portion of horizontal slot 126. In this position, locking pin 122 is no longer constrained by open ended slot 128, and thus steering module 44 and motor mount 96 may continue to move in direction 134 until trolling motor unit 20 is in the fully stowed position. Before or simultaneously with this transition from the deployed position to the stowed position, trim module 44 adjusts the height of motor power unit 52 relative to steering module 44 so that motor power unit 52 will rest upon propeller mounts 112 as described above.

Figure 18:
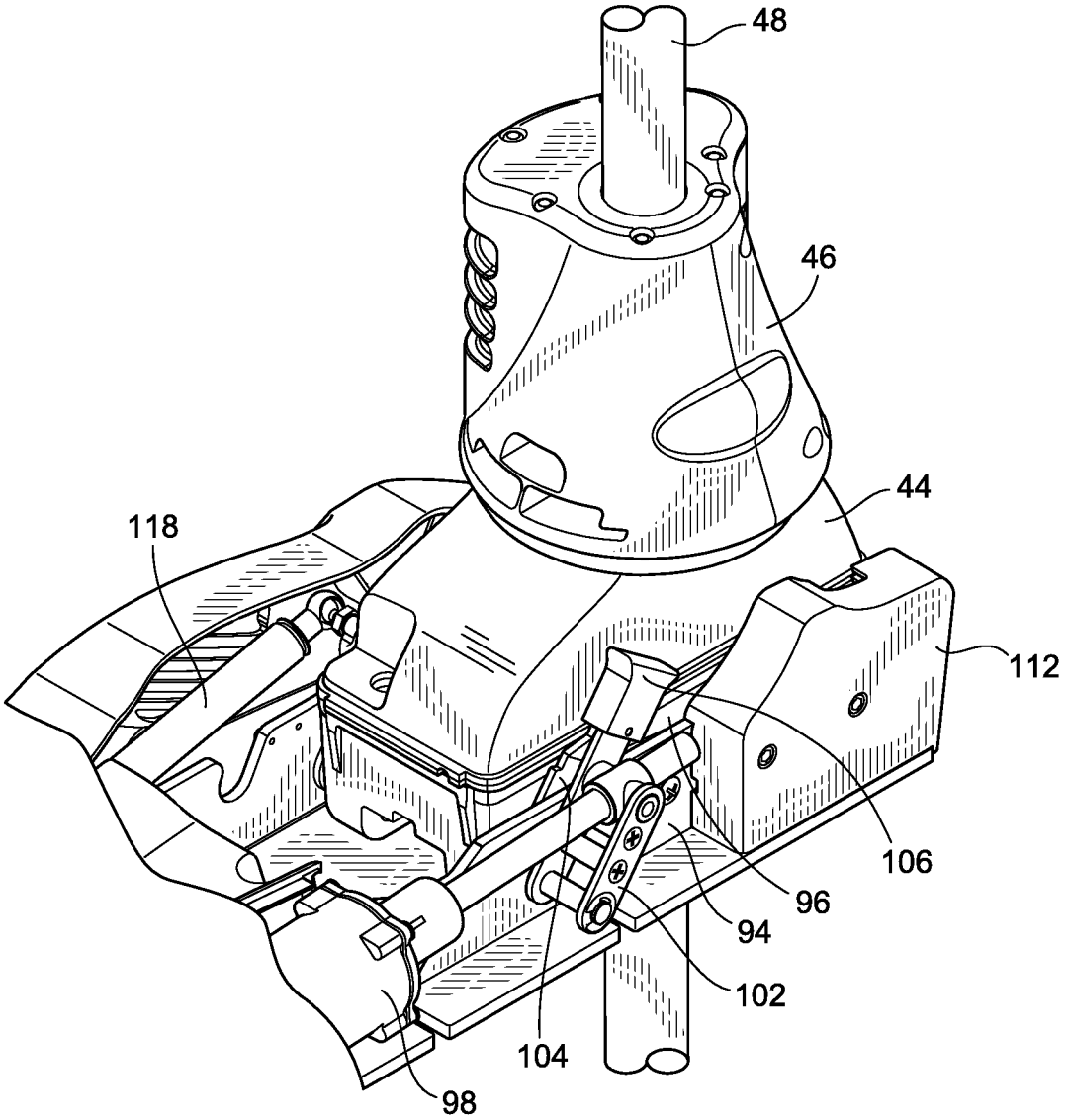
FIG. 18 is a perspective view showing the linkage between the motor mount and the base, particularly a manual release arrangement.
Figure 19:
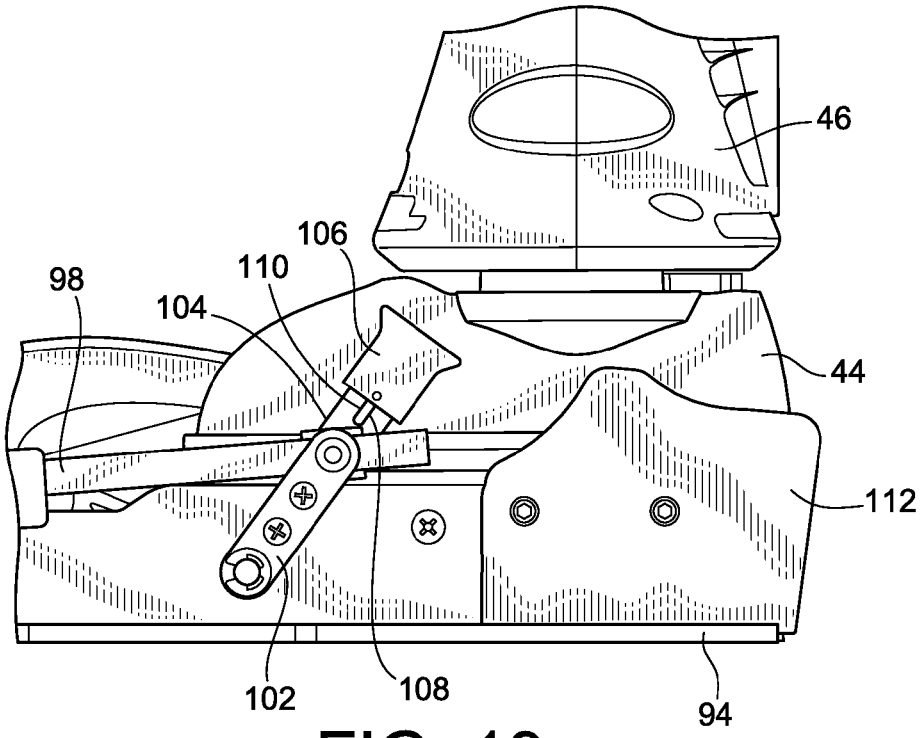
FIGS. 19-20 are side views illustrating the operation of the manual release arrangement of FIG. 18.
Figure 20:
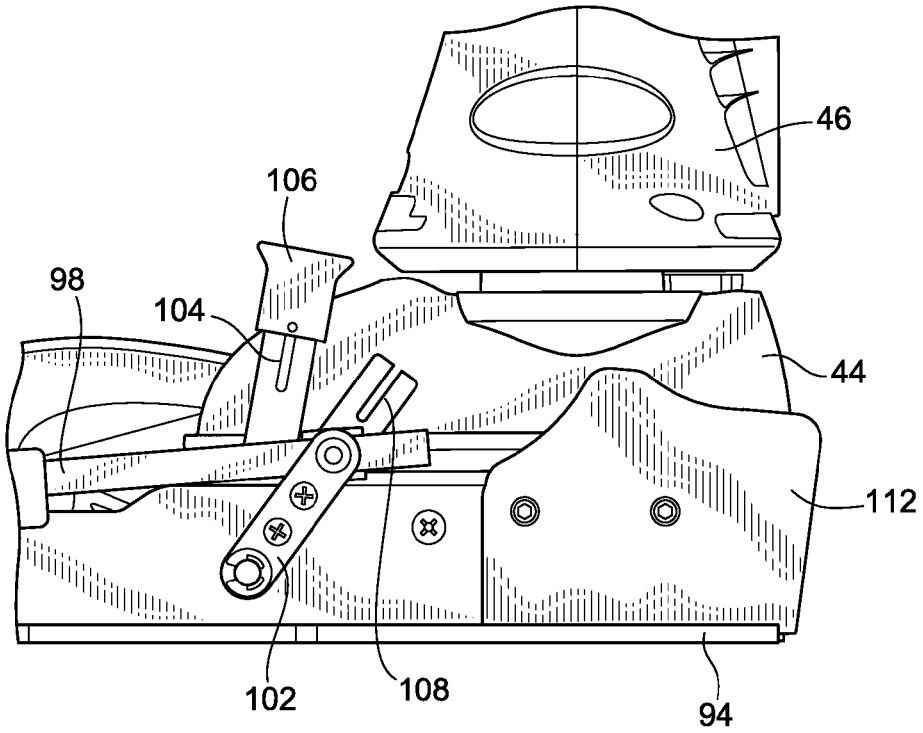

Turning now to FIGS. 18-20, the capability to manually transition trolling motor unit 20 from the fully deployed position to the fully stowed position and vice versa will be described in greater detail. This capability is particularly advantageous where there is a loss of power such that linear actuator 98 is no longer operable to place trolling motor unit 20 in the stowed position or in the deployed position.

With particular reference to FIG. 18, as discussed above, the coupling arrangement 100 formed between linear actuator 98 and motor mount 96 include a first link 102 and second link 104 with a locking member 106 coupling links 102, 104 together. First link 102 is connected to linear actuator 98 as shown. Second link 104 is a rigid extension of motor mount 96. Locking member 106 is a slideable cap which is slideable relative to first and second links 102, 104 to selectively couple and decouple the same. When first and second links 102, 104 are coupled to one another, extension and retraction of linear actuator 98 in turn causes rotation of first link 102 about first axis 22 and a like rotation of second link 104 as well as motor mount 96 about first axis 22.

However, and turning now to FIG. 19, an extension of first link 102 includes an open ended slot 108. Second link 104 includes a closed ended slot 110. Locking member 106 is a cap member having a set screw that passes therethrough and through each of open ended and close ended slot 108, 110. Locking member 106 is slideable relative to first and second links 102, 104 to displace the set screw thereof out of open ended 108. This configuration is shown in FIG. 20. As can be seen therein, locking member 106 has been linearly moved along each of first and second links 102, 104 such that the set screw thereof is no longer within open ended slot 108. However, and because of closed ended slot 110, locking member 106 remains situated on second link 104.

In this configuration, however, motor mount 96 and the componentry carried thereby may be manually rotated without affecting the currently extended position of linear actuator 98 to place trolling motor unit 20 in the stowed position. Such manual operation may also include adjusting the trim thereof by manually sliding motor shaft 48, head unit 50 motor power unit 52 and trim module 46 relative to steering module 44 to locate motor power unit 52 on propeller mounts 112 as described above. This selectively manually operable system advantageously allows stowing trolling motor unit 20 in the event of a power loss wherein linear actuator 98 is no longer operable to place trolling motor unit 20 in the stowed position.

Figure 21:
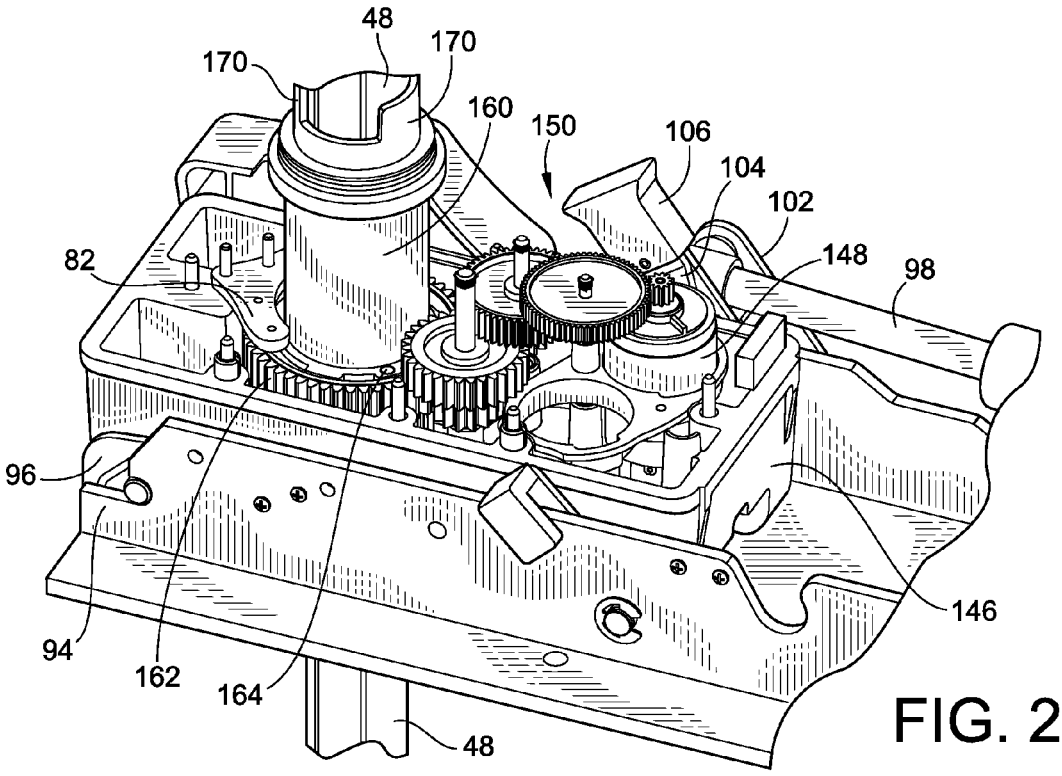
FIG. 21 is a perspective view of the trolling motor, with an interior of a steering module of the trolling motor exposed.

Turning now to FIGS. 21-26, the steering and trim modules 44, 46 will be discussed in greater detail. With particular reference to FIG. 21, steering module 44 is shown in greater detail with a portion of the housing covering 146 removed therefrom for purposes of clarity and to expose an internal drive arrangement thereof. As can be seen in this view, steering module 44 includes a motor 148 which includes a drive gear which drives a drive train 150. As can be seen from inspection of FIG. 21, drive train 150 includes a collection of interconnected gears which those skilled in the art will recognize may vary in their number and construction to transmit an appropriate driving torque between motor 148 and a drive gear 162. A drive collar 160 extends rigidly from drive gear 162 and is mounted for rotation with drive gear 162. As will be explained in greater detail below, drive gear 162 and drive collar 160 are rotatable relative to motor shaft 48. Drive collar 162 engages trim module 46 and rotates trim module 46 commensurate with the rotation of drive collar 160 and drive gear 162. However, motor shaft 48 is not free for rotation relative to trim module 46 and vice versa. As a result, by rotating trim module 46, drive gear 162 and drive collar 160 ultimately effectuate the steering of trolling motor unit 20 by rotating motor shaft 48 about the second axis 22 in first and second rotational directions 30, 32 as shown in FIG. 1.

Indeed, end protrusions 170 formed at the end of drive collar 160 extend into apertures formed in a bottom wall of trim module 46 to effectuate the rotation thereof as described below. Additionally, steering sensor 82 introduced above is incorporated within steering module 44 to detect the rotational position of drive collar 160 and/or drive gear 162. In the embodiment illustrated, steering sensor 82 is a Hall effect sensor which detects the rotation of drive gear 162 by counting successive passage of magnetic elements 164 mounted in drive gear 162. It should be noted that other types of rotational sensors could be utilized, e.g. a rotary encoder, etc. Further, more than a single sensor 82 may be employed. This information is collected by internal control module 58 for purposes of steering control.

Figure 22:
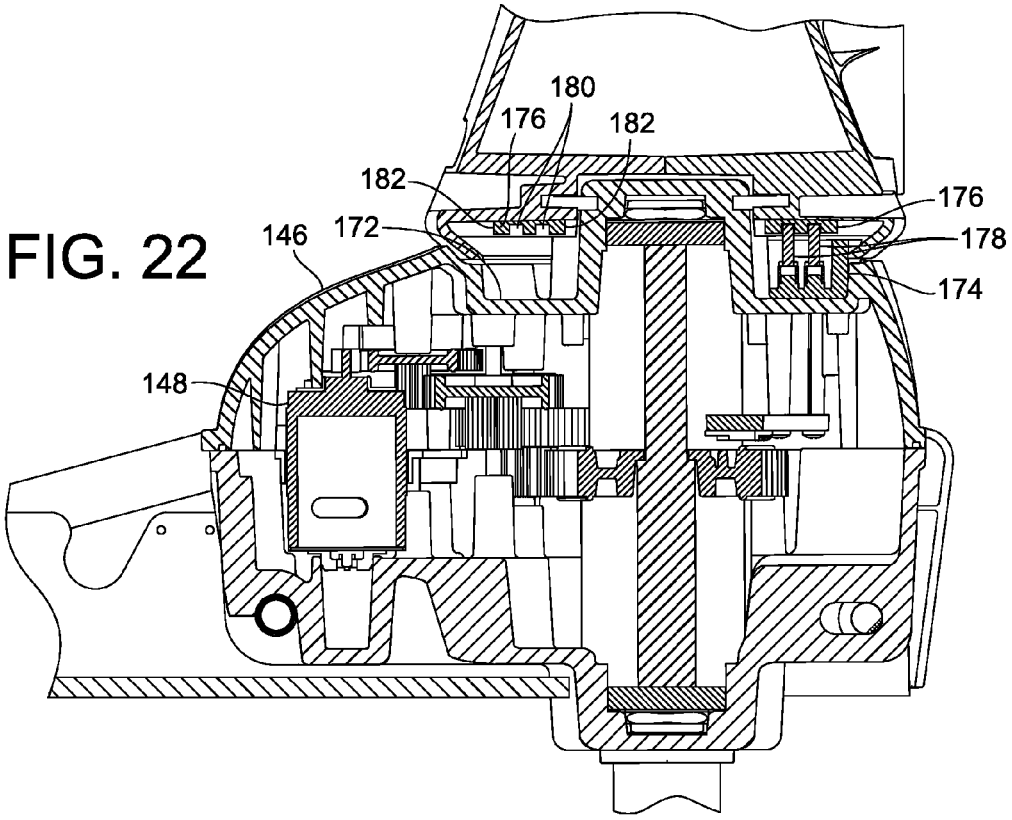
FIG. 22 is a perspective cross section of the steering and trim modules.
Figure 23:
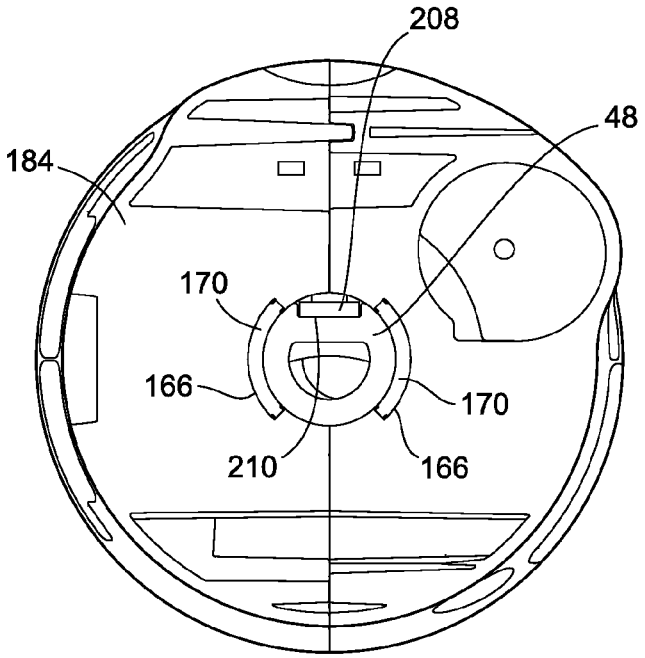
FIG. 23 is a top cross section through the trim module.

Turning now to FIGS. 22-23, as can be seen therein, protrusions 170 extend away from drive collar 160 and extend through apertures 166 formed in bottom wall 184 of trim module 46 (See FIG. 23). As can also be seen in this view, motor shaft 48 is generally a hollow member such that the above referenced lead wires (not shown) may be fed between head unit 50 and motor power unit 52.

As can also been seen from inspection of FIG. 22, trim module 46 is positioned on a top outer surface of housing module 44 such that it may smoothly and freely rotate relative thereto upon rotation of drive collar 160 as discussed above.

As can also be seen from inspection of FIG. 22, a slip ring 176 is positioned between trim module 46 and steering housing 44. A contact element 174 which includes electrical contacts 178 extending therefrom is mounted within a groove 172 formed in a top surface of steering module 44. This contact element 174, including its contacts 178, receives electrical power through internal control module 58 of base assembly 42. Slip ring 176 includes a pair of electrical contact rings 180 formed in contact grooves 182 of slip ring 176. As can be seen in FIG. 22, contacts 178 extend into contact grooves 182 and make electrical contact with contact rings 180. Contact rings 180 are operably connected to the internal control module 60 of trim module 46 to provide electrical power thereto. While only a single contact element 174 is illustrated in FIG. 22, it will be immediately recognized that multiple contact elements 174 could be situated within group 172 and commonly connected to internal control module 58 of base assembly 42.

Figure 24:
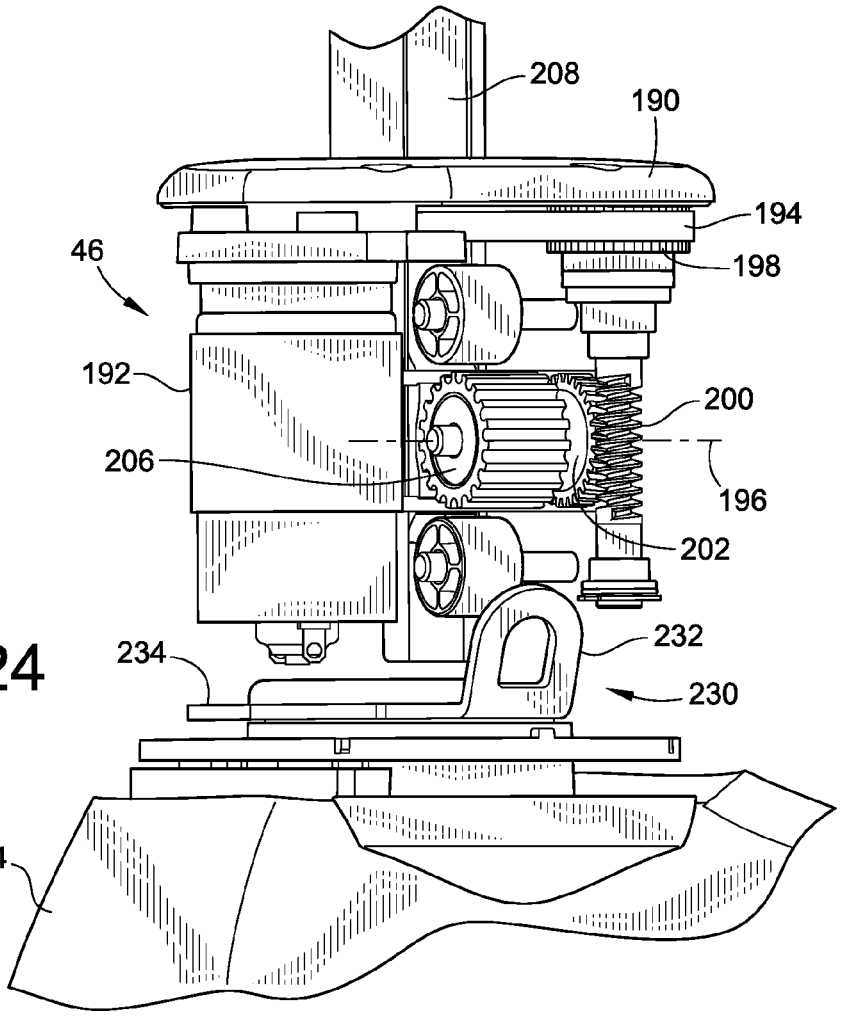
FIG. 24 is a partial view of the trim module, with an interior thereof exposed.
Figure 25:
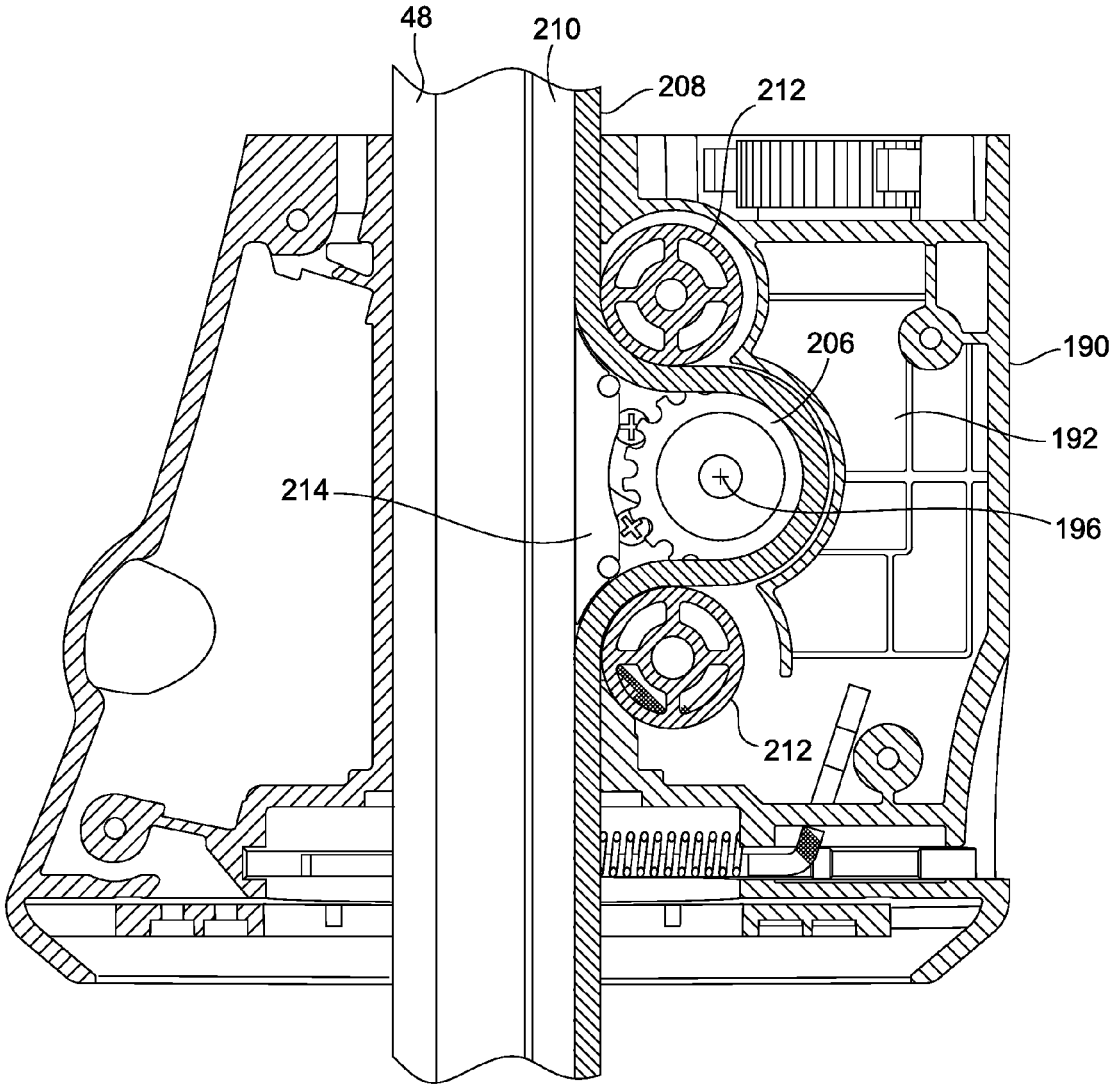
FIG. 25 is a partial cross section of the trim module.
Figure 26:
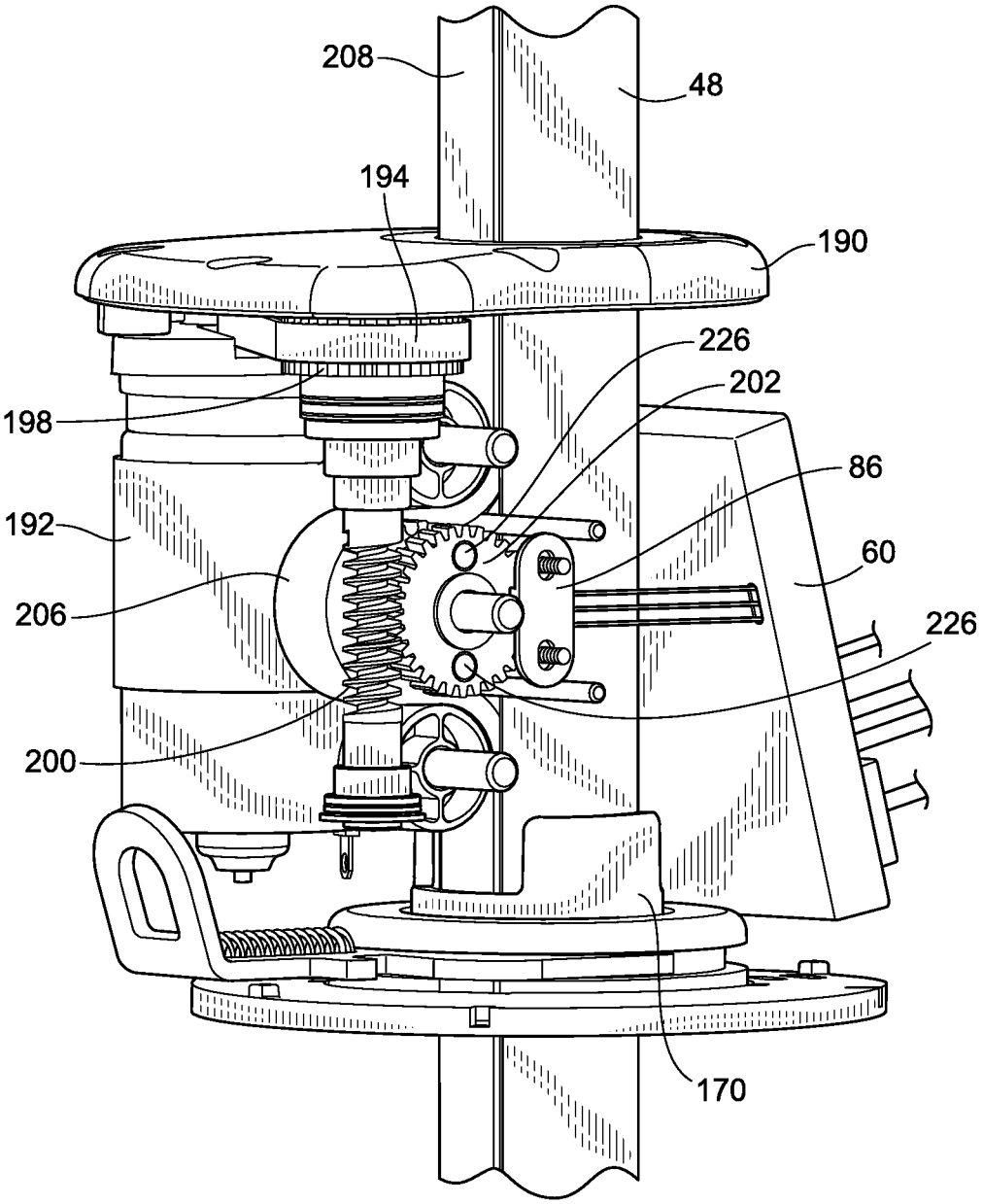
FIG. 26 is another perspective view of the interior of the trim module.

Turning now to FIGS. 24-26, the internal drive arrangement of trim module 46 will be described in greater detail. In FIG. 24, portions of an outer housing 190 of trim module 44 have been removed for clarity. Within trim module 44, a drive motor 192 is provided. Drive motor 192 is powered and controlled by internal control module 60, which as discussed above receives its electrical power through the above described slip ring arrangement.

Drive motor 192 is connected by way of a drive belt 194 to an input drive gear 198. A worm gear 200 is operably connected to input drive gear 198 such that rotation of input drive gear 198 results in rotation of worm gear 200. An intermediary drive gear 202 is in meshed contact with worm gear 200. As a result, rotation of worm gear 200 also results in a rotation of intermediary drive gear 202 about axis 196 as illustrated. Intermediary gear 202 is coupled to a belt drive gear 206 which is mounted for rotation with intermediary drive gear 202 about axis 196. Belt drive gear 206 meshes with serrations (not shown) formed in belt 208. It will be recognized that in FIG. 24 portions of belt 208 have been removed for purposes of clarity. As can also be seen in FIG. 24, trim module 46 includes a manual release arrangement 230 that includes a tab 232 rigidly connected to a bracket 234. When tab 232 is pulled radially way from trim module 46, bracket 234 will become de-coupled from the illustrated portion of steering module 44. This de-coupling allows for the relative linear movement of trim module 46 with motor shaft assembly relative to the remainder of trolling motor 20. Such functionality, when combined with the manual stow/deploy operation described above allows a user to place trolling motor 20 in the fully stowed position in the event of a power failure or other malfunction.

Turning now to FIG. 25, the contact between belt 208 and belt drive gear 206 is illustrated. Belt 208 is retained within a channel 210 formed along motor shaft 48 (See also FIG. 23). It is also connected at its ends to the ends of motor shaft 48. A portion of belt 208 extends outwardly from channel 210 and wraps around belt drive gear 206. Because belt 208 cannot move linearly relative to motor shaft 48, rotation of belt drive gear 206 causes the linear motion of motor shaft 48 along second axis 28 in first and second linear direction 34, 36 as described above relative to FIG. 1. Additionally, guide rollers 212 are disposed on either side of belt drive gear 206 to aid in routing belt 208 as shown. Those skilled in the art will recognize that instead of utilizing belt 208, motor shaft 48 may include a rack (i.e. a plurality of gear-like projections) along its length which can mesh with belt drive gear 206 in a rack and pinion style configuration. Yet further, in other embodiments, belt drive gear 206 may be omitted entirely and motor shaft 48 may present a smooth surface against which one or more tension rollers of trim module bear against in such a manner as to linearly move motor shaft 48 by their rotation.

Still referring to FIG. 25, a torque transfer arrangement in the form of a torque tab 214 is mounted by pins 216 within trim module 46. This torque tab 214 extends into channel 210. As a result, rotation of trim module 46 causes a torque to be transferred through torque tab 214 to motor shaft 48 to effectuate the steering thereof. Indeed, torque tab 214 extends into channel 210 formed in motor shaft 48 such that motor shaft 48 is not free for rotation relative to trim module 46. However, torque tab 214 does not inhibit the linear motion of motor shaft 48 relative to trim module 46 as a result of the rotation of belt drive gear 206.

Turning now to FIG. 26, intermediary drive gear 202 can also include magnetic elements 218 formed therein. Trim sensor 86 in the form of a Hall effect sensor is situated to count revolutions of intermediary drive gear 202 by detecting the rotation of magnetic elements 226. This information is fed to internal control module 60 of trim module 46 for purposes of determining the trimmed position of motor shaft 48. It will be recognized by those of skill in the art that the above-described worm gear type drive train of trim module 46 overcomes existing problems in the art by providing a far more efficient trim adjustment package for a trolling motor than prior designs which utilize more complex chain drive type assemblies and the like.

It is also contemplated that trim module 46 may be provided as a stand alone system that may be retrofit with an existing motor shaft assembly, e.g. a motor shaft assembly that relies upon manual trim adjustment. In such an embodiment, trim module may omit the use of the above described slip ring, and instead rely upon a direct connection of its internal control arrangement 60 to power source 64. Such a system may also include a stand alone wireless or hard wired controller connected to internal control arrangement 60 to effectuate the user controlled operation thereof. Such a system may utilize the above described actuation arrangements, e.g. a belt drive gear, a rack and pinion style drive, or a friction roller drive for linearly moving motor shaft assembly through the bore of trim module 46.

As introduced above, additional mounting brackets may also be utilized for mounting trolling motor unit 20.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A trolling motor unit, comprising:

a base assembly including a motor mount and a base plate, the motor mount rotatably mounted to the base plate such that the motor mount is rotatable relative to the base plate about a first axis;

a steering module rotatably mounted to the base assembly such that the steering module is rotatable relative to the base plate about the first axis;

a trim module rotatably mounted to an upper portion of the steering module, the trim module rotatable about a second axis transverse to the first axis and rotatable about the first axis with the steering module;

a motor shaft assembly including a motor shaft, a head unit attached to an upper end of the motor shaft, and a motor power unit attached to a lower end of the motor shaft, the motor shaft extending through the base assembly, steering module, and trim module, the motor shaft assembly linearly movable relative to each of the base assembly, steering module, and trim module about the second axis and rotatable about the second axis relative to the steering module and base assembly, the motor shaft assembly rotatable about the first axis with the trim module, steering module, and motor mount;

a linear actuation arrangement mounted between the base plate, the motor mount, and the steering module for rotating the motor mount, steering module, trim module, and motor shaft assembly simultaneously about the first axis.

2. The trolling motor unit of claim 1, wherein the linear actuation arrangement includes a damper and a linear actuator mounted on opposed sides of the base plate.

3. The trolling motor unit of claim 2, wherein the linear actuator includes an end effector which is coupled to a coupling arrangement formed between the base plate and the motor mount.

4. The trolling motor unit of claim 3, wherein the coupling arrangement includes a first link rotatably mounted to the base plate and rotable about the first axis, and a second link which is a rigid extension of the motor mount.

5. The trolling motor unit of claim 4, further comprising a locking member selectively coupling the first link to the second link such that in a locked configuration the second link cannot rotate about the first axis relative to the first link, and in an unlocked configuration, the second link is free for rotation about the first axis relative to the first link.

6. The trolling motor unit of claim 1, wherein the trim module includes an internal drive arrangement for linearly moving the motor shaft assembly about the second axis, the internal drive arrangement including a drive motor operably coupled to an input drive gear of the internal drive arrangement, the input gear mounted for rotation about a first input axis, the internal drive arrangement further comprising a worm gear mounted for rotation with the input drive gear and extending along the first input axis, wherein the first input axis is parallel to the second axis.

7. The trolling motor unit of claim 6, wherein the internal drive arrangement further comprises an intermediary drive gear rotatably mounted about a second input axis which is perpendicular to the first input axis, the intermediary drive gear in meshed contact with the worm gear.

8. The trolling motor unit of claim 7, wherein the internal drive arrangement further comprises a belt drive gear coupled for rotation with the intermediary drive gear about the second input axis.

9. The trolling motor unit of claim 8, wherein the motor shaft assembly includes a belt mounted within a channel of the motor shaft, the belt including a plurality of gear teeth on an interior side thereof, wherein a portion of the belt is routed around the belt drive gear and in meshed contact therewith.

10. The trolling motor unit of claim 1, wherein the steering module includes an internal drive arrangement including an input drive motor, a drive gear, and a drive train coupled between the input drive motor and the drive gear.

11. The trolling motor unit of claim 10, wherein a drive collar extends axially way from the drive gear and is rotatable with the drive gear about the second axis, and wherein the motor shaft extends through the drive gear and drive collar.

12. The trolling motor unit of claim 11, wherein a pair of protrusions extend axially way from the drive collar and axially away from an upper outer surface of the steering module, the pair of protrusions received within a pair of corresponding apertures formed through a bottom wall of the trim module such that rotation of the drive collar about the second axis results in a like rotation of the trim module about the second axis.

13. A trolling motor unit, comprising:

a base assembly;

a steering module mounted to the base assembly, the steering module including an internal drive arrangement for providing an output torque;

a trim module rotatably mounted to an upper portion of the steering module by the output torque;

a motor shaft assembly including a motor shaft, a head unit attached to an upper end of the motor shaft, and a motor power unit attached to a lower end of the motor shaft, the motor shaft extending through the base assembly, steering module, and trim module;

a slip ring assembly positioned between steering module and the trim module; and wherein electrical power is transmitted from an internal control module of the steering module through the slip ring assembly and to the trim module to provide electrical power to the slip ring assembly.

14. The trolling motor unit of claim 13, wherein the base assembly includes a linear actuation arrangement comprising a damper and a linear actuator mounted on opposed sides of a base plate of the base assembly.

15. The trolling motor unit of claim 14, wherein the linear actuator includes an end effector which is coupled to a coupling arrangement formed between the base plate and a motor mount of the base assembly, the motor mount rotatable relative to the base plate.

16. The trolling motor unit of claim 13, wherein the trim module includes an internal drive arrangement for linearly moving the motor shaft assembly, the internal drive arrangement including a drive motor operably coupled to an input drive gear of the internal drive arrangement, the input gear mounted for rotation about a first input axis, the internal drive arrangement further comprising a worm gear mounted for rotation with the input drive gear and extending along the first input axis.

17. The trolling motor unit of claim 16, wherein the internal drive arrangement further comprises an intermediary drive gear rotatably mounted about a second input axis which is perpendicular to the first input axis, the intermediary drive gear in meshed contact with the worm gear.

18. The trolling motor unit of claim 17, wherein the internal drive arrangement further comprises a belt drive gear coupled for rotation with the intermediary drive gear about the second input axis.

19. The trolling motor unit of claim 18, wherein the motor shaft assembly includes a belt mounted within a channel of the motor shaft, the belt including a plurality of gear teeth on an interior side thereof, wherein a portion of the belt is routed around the belt drive gear and in meshed contact therewith.

20. The trolling motor unit of claim 13, wherein the steering module includes an internal drive arrangement including an input drive motor, a drive gear, and a drive train coupled between the input drive motor and the drive gear.

* * * * *